US005356750A

United States Patent [19]

Texter et al.

[11] Patent Number: 5,356,750

[45] Date of Patent: * Oct. 18, 1994

[54] DYE RELEASING COUPLERS FOR HEAT IMAGE SEPARATION SYSTEMS

[75] Inventors: John Texter, Rochester; Thomas R. Welter, Webster; David T. Southby; Jared B. Mooberry, both of Rochester, all of N.Y.

[73] Assignee: Eastman Kodak Company, Rochester, N.Y.

[ * ] Notice: The portion of the term of this patent subsequent to Dec. 14, 2010 has been disclaimed.

[21] Appl. No.: 993,580

[22] Filed: Dec. 21, 1992

[51] Int. Cl.[5] ..... G03C 5/54

[52] U.S. Cl. ..... 430/203; 430/226; 430/546

[58] Field of Search ..... 430/203, 226, 201, 199, 430/546

[56] References Cited

U.S. PATENT DOCUMENTS

| | | | |
|---|---|---|---|
| 3,743,504 | 7/1973 | Dappen et al. . | |
| 4,141,730 | 2/1979 | Minagawa et al. . | |
| 4,248,962 | 2/1981 | Lau . | |
| 4,420,556 | 12/1983 | Booms . | |
| 4,483,914 | 11/1984 | Naito et al. | 430/226 |
| 4,507,380 | 3/1985 | Naito et al. | 430/226 |
| 4,584,267 | 4/1986 | Masukawa et al. . | |
| 4,665,005 | 5/1987 | Aono et al. | 430/203 |
| 4,840,884 | 6/1989 | Mooberry et al. . | |
| 4,847,188 | 7/1989 | Komamura et al. | 430/226 |
| 4,948,698 | 8/1990 | Komamura | 430/548 |
| 5,032,499 | 7/1991 | Kohno et al. | 430/203 |
| 5,164,280 | 11/1992 | Texter et al. | 430/202 |

FOREIGN PATENT DOCUMENTS

| | | |
|---|---|---|
| 0115303 | 10/1989 | European Pat. Off. . |
| 3324533A1 | 12/1984 | Fed. Rep. of Germany . |
| 4-73751 | 3/1992 | Japan . |

*Primary Examiner*—Richard L. Schilling
*Attorney, Agent, or Firm*—Paul A. Leipold

[57] ABSTRACT

An aqueous-developable photographic color diffusion transfer element comprising a single dimensionally stable support and one or more layers comprising radiation sensitive silver halide, thermal solvent for facilitating the thermal diffusion of dyes through a hydrophilic binder, a dye-releasing coupler, and hydrophilic binder, wherein said dye is heat diffusible in said binder and thermal solvent, and wherein said dye-releasing coupler is of the structure Cp—L-Dye where Cp is a cyan dye forming radical, magenta dye forming radical, yellow dye forming radical, black dye forming radical, or colorless product forming radical, said Cp being substituted in the coupling position with a divalent linking group, L;

Dye is a dye radical exhibiting selective absorption in the visible spectrum; and where said —L-Dye group couples off upon reaction of said coupler radical with the oxidation product of a primary amine developing agent is disclosed.

56 Claims, No Drawings

DYE RELEASING COUPLERS FOR HEAT IMAGE SEPARATION SYSTEMS

RELATED APPLICATIONS

This application is related to the following applications filed previously: *Heat Image Separation Systems* of Willis and Texter, filed Dec. 6, 1991 as U.S. application Ser. No. 07/804,877; *Thermal Solvents for Dye Diffusion in Image Separation Systems* of Bailey et al., filed Dec. 6, 1991 as U.S. application Ser. No. 07/804,868; and *Polymeric Couplers for Heat Image Separation Systems* of Texter et al., filed Aug. 10, 1992 as U.S. application Ser. No. 07/927,691.

FIELD OF THE INVENTION

This invention relates to photographic systems and processes for forming a dye image in a light sensitive silver halide emulsion layer, and subsequently separating the dye image from the emulsion layer. More particularly, this invention relates to said processes comprising aqueous alkaline development for forming dye images in silver halide emulsion layers and to thermal dye-diffusion image-separation systems.

BACKGROUND OF THE INVENTION

Conventional Aqueous Development Systems

In conventional "wet" or aqueous silver halide based color photographic processing systems, an imagewise exposed photographic element, for example color paper designed to provide color prints, is processed in a color developer solution. The developer reduces the exposed silver halide of the photographic element to metallic silver and the resulting oxidized developer reacts with incorporated dye-forming couplers to yield dye images corresponding to the imagewise exposure. As silver is generally gray and desaturates the pure colors of the dyes, it is desirable to remove it from the dye images. Silver is conventionally separated from the dye images by a process of bleaching the silver to a silver salt and removing the silver halide by using an aqueous solvent, a fixing bath. This fixing bath also removes the undeveloped original silver halide. Commonly, the bleach and fix are combined into one solution, a bleach-fix solution. Bleach-fix solutions commonly contain iron, ammonium, EDTA (ethylenediaminetetraacetic acid), thiosulfate and, after use, silver ion. These components of "wet" or aqueous silver halide processing can be the source of much of the pollution from photofinishing processes.

Heat Developable Systems

"Dry" silver halide based color photographic processing systems have been proposed which employ thermally developable color photographic material. Such thermally developable materials generally comprise a light sensitive layer containing silver halide, a photographic coupler or other dye-providing material, and a color developing agent as disclosed, e.g., in U.S. Pat. Nos. 4,584,267 and 4,948,698 and references cited therein. After image-wise exposure, these elements can be developed by uniformly heating the element to activate the developing agent incorporated therein, thereby eliminating the need for aqueous processing with a developer solution. In some thermally developable systems, the dye-providing materials are designed to form diffusible dyes upon heat development, which may be transferred to an image-receiving layer either during thermal development or thereafter in a separate step. Such thermally developable diffusion transfer color photography systems are disclosed in U.S. Pat. Nos. 4,584,267 and 4,948,698 referenced above. These systems also eliminate the need for bleach-fix steps with processing solutions and the resulting effluent wastes.

Heat Image Separation Systems

A novel method of imaging, whereby conventional aqueous development processes are utilized in combination with substantially dry thermally activated diffusion transfer of image dyes to a polymeric receiver has been described by Willis and Texter in U.S. application Ser. No. 07/804,877, filed Dec. 6, 1991, now U.S. Pat. No. 5,270,145, *Heat Image Separation Systems* and by Bailey et al. in U.S. application Ser. No. 07/804,868,, filed Dec. 6, 1991, *Thermal Solvents for Dye Diffusion in Image Separation Systems.* The disclosures of these cited applications are incorporated herein in their entirety by reference for all that they disclose. The morphology of a photographic element for such systems generally consists of a (1) dimensionally stable support of transparent or reflection material, (2) a receiver layer to which the diffusible dyes migrate under thermal activation, (3) optionally a stripping layer, (4) one or more diffusible-dye forming layers in which the light image is captured and amplified during conventional aqueous color development, and (5) a protective overcoat. Latent image in the diffusible-dye forming layers is captured using well known silver halide technology and these images are amplified in conventional aqueous color development. After development the element is subjected to a stop/-wash bath, dried, and then heated to drive the diffusible-dye image to the receiver. Thereafter, the support and receiver layer are separated from the diffusible-dye forming layers by a stripping method, such as that disclosed by Texter et al. in U.S. Pat. No. 5,164,280, *Mechanicochemical Layer Stripping in Image Separation Systems,* the entire disclosure of which is incorporated herein by reference. The separated diffusible-dye forming layers may subsequently be used as a source of recoverable silver and other fine chemicals.

Diffusible-Dye Releasing Couplers

Dappen and Smith in U.S. Pat. No. 3,743,504 disclose the use of immobile diffusible-dye-forming couplers and immobile diffusible-dye-releasing couplers in a color diffusion transfer system.

Minagawa, Arai, and Ueda in U.S. Pat. No. 4,141,730 disclose the use of immobile colored coupling compounds which release diffusible dye during color development. These compounds are used to advantage in masking applications.

Lau, in U.S. Pat. No. 4,248,962, discloses dye releasing couplers wherein dyes are anchimerically released by coupling-off groups subsequent to reaction of oxidized aromatic amine developers with said couplers.

Sakanoue, Hirano, Adachi, Minami, and Kanagawa in German Offen. No. 3,324,533 A1, Booms and Holstead in U.S. Pat. No. 4,420,556, and Arakawa and Watanabe in European Patent Specification 115,303 B1 disclose the use of diffusible dye forming couplers to provide photographic materials with improved graininess.

Mooberry and Singer, in U.S. Pat. No. 4,840,884, disclose dye-releasing couplers that release electrically neutral dyes and wherein said dyes are released from a coupling-off group comprising a dye and a divalent linking group of the formula —L—NR—, wherein L is a divalent linking group and NR is a substituted nitrogen atom.

PROBLEM TO BE SOLVED BY THE INVENTION

Bleach-fix solutions commonly contain iron, ammonium, EDTA, thiosulfate and, after use, silver. These components of "wet" or aqueous silver halide processing are the cause of much of the effluent treatment required after the photofinishing processes. There is a continuing need to reduce and eliminate effluent containing said bleach-fix components.

Thermally diffusible dyes in heat image separation systems, obtained as indoaniline dyes upon coupling of an oxidized primary amine developing agent with a cyan-, magenta-, or yellow-dye forming coupler, have limited extinction coefficients that often require an excessive amount of coated coupler and development in order to achieve a given maximum dye-density. Most such yellow image dyes, for example, have extinction coefficients in the range of 17,000–19,000 L $mol^{-1}$ $cm^{-1}$. There is a continuing need for couplers that provide dyes with significantly higher extinction coefficients, so that desired maximum dye densities can be achieved with lower levels of coated coupler and silver, and therefore with lower manufacturing cost.

Indoaniline type dyes obtained in conventional color development of heat image separation systems often have severe dye stability problems that result from heated storage or from exposure to medium or high levels of daylight.

SUMMARY OF THE INVENTION

It is an object of the invention to overcome disadvantages of prior processes and products. It is an object of our invention to reduce the amount of waste processing solution effluents generated by the overall processing system while retaining the benefits of image quality and industry compatibility which are derived from aqueous development with conventional developing solutions.

An object of the present invention is to provide improved image dye retention in the photographic element and improved image dye hue in said element. Yet another object of the present invention is to minimize the seasoning of processing solutions with diffusible dyes. An additional object of the present invention is to minimize the amount of solid waste generated in the photofinishing of color print materials.

In accordance with this invention an aqueous-developable photographic color diffusion transfer element is provided, where said element comprises a single dimensionally stable support, a radiation sensitive silver halide containing layer, a thermal solvent containing layer for facilitating the thermal diffusion of dyes through a hydrophilic binder, and a dye-releasing coupler containing layer, wherein said layers comprise hydrophilic binder, wherein said dye is heat diffusible in said binder and thermal solvent, and wherein said dye-releasing coupler is of the structure Cp—L-Dye where Cp is a cyan dye forming radical, magenta dye forming radical, yellow dye forming radical, black dye forming radical, or colorless product forming radical, said Cp being substituted in the coupling position with a divalent linking group, L;

Dye is a dye radical exhibiting selective absorption in the visible spectrum; and where said —L-Dye group couples off upon reaction of said coupler radical with the oxidation product of a primary amine developing agent.

ADVANTAGEOUS EFFECT OF THE INVENTION

The present invention reduces the amount of waste processing solution effluent generated by the overall processing system while retaining the benefits of image quality and industry compatibility derived from aqueous development with conventional developing solutions. The use of dye-releasing couplers provides several important advantages, including being able to design dye-releasing couplers wherein it is possible to control independently the properties of the released dye, the properties of the linking and timing chemistry, and the properties of the parent coupler. The incorporation and use of dyes having higher extinction coefficients is a particularly attractive advantage provided by the present invention.

DETAILED DESCRIPTION OF THE INVENTION

The term "nondiffusing" used herein as applied to the couplers and diffusible-dye forming compounds has the meaning commonly applied to the term in color photography and denotes materials, which for all practical purposes, do not migrate or wander through water swollen organic colloid layers, such as gelatin, comprising the sensitive elements of the invention at temperatures of 40° C. and lower. The term "diffusible" as applied to dyes formed from these "nondiffusing" couplers and compounds in the processes has somewhat of a converse meaning and denotes materials having the property of diffusing effectively through relatively dry colloid layers of the sensitive elements in the presence of the "nondiffusing" materials from which they are derived. The terms "dye-receiving" and "image-receiving" are used synonomously herein. In the following discussion of suitable materials for use in the elements and methods of the present invention, reference is made to *Research Disclosure.* December 1989, Item 308119, pages 993–1015, published by Kenneth Mason Publications, Ltd., Emsworth, Hampshire PO 10 7DQ, United Kingdom, the disclosure of which is incorporated herein in its entirety by reference. This publication is identified hereafter as "Research Disclosure".

Element Layer Structure

A suitable integral layer structure for elements of the present invention generally consists of a (1) dimensionally stable support of transparent or reflection material, (2) a receiver layer to which the diffusible dyes migrate under thermal

TABLE 1

| Integral Layer Structure for Element of the Present Invention |
|---|
| Protective Overcoat Layer |
| Imaging Layer(s) |
| Stripping Layer |
| Dye-Receiving Layer(s) |
| Support |

activation, (3) optionally a stripping layer, (4) one or more imaging layer(s) (comprising silver halide and diffusible-dye releasing couplers) in which the light image is captured and amplified during conventional aqueous color development, and (5) a protective overcoat. This structure is illustrated in Table 1. Stripping layers in such structures may be omitted. The imaging layer(s) and overcoat layer comprise a "donor" element. The support and dye-receiving layer comprises a "receiving" element.

Another suitable structure for elements of the present invention is the nonintegral structure illustrated in Table 2, where separate donor and receiver elements are shown. The donor element comprises a support, one or more imaging layers, and optionally a protective overcoat layer. Such a donor element, subsequent to aqueous development and drying, is laminated to a suitable receiver element and heated to effect image dye transfer. Suitable receiver elements generally comprise a support and a dye-receiving layer or layers.

TABLE 2

| Laminate Layer Structure for Element of the Present Invention |
|---|
| Receiver Support |
| Dye-Receiving Layer(s) |
| Protective Overcoat Layer |
| Diffusible-Dye Releasing (Imaging) Layer(s) |
| Donor Support |

The photographic elements can be coated on a variety of supports such as described in Research Disclosure, Section XVII and the references described therein. Typical of useful paper supports are those which are partially acetylated or coated with baryta and/or a polyolefin, particularly a polymer of an α-olefin containing 2 to 10 carbon atoms, such as polyethylene, polypropylene, copolymers of ethylene and propylene and the like. Preferred paper-base supports also comprise auxiliary pigments such as titania (anitase, rhutile) to improve the reflectivity to visible light of said support. Suitable supports of the present invention can contain optical brighteners (see Research Disclosure, Section V). Suitable supports also include transparent film supports. In the integral layer structure illustrated in Table 1 and in the receiver element illustrated in Table 2, said support and receiver support may each independently be a transparent film support or an opaque reflection support, depending on the desired application and use of the resulting print material (receiver element). In the donor element illustrated in Table 2, said donor support preferably is an opaque reflection support. Said donor support may be a transparent film support.

Dye-Receiving Layers

The dye-receiving layer or layers to which the formed dye image is transferred according to the present invention may be coated on the photographic element between the emulsion layer and support as is illustrated in Table 1, or may be in a separate dye-receiving element which is brought into contact with the photographic element during the dye transfer step, as is illustrated in Table 2. If present in a separate receiving element, the dye receiving layer may be coated or laminated to a support such as those described for the photographic element support above, or may be self-supporting. In a preferred embodiment of the invention, the dye-receiving layer is present between the support and silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-coacrylonitrile)s, poly(caprolactone)s and mixtures thereof. The dye receiving layer may be present in any amount which is effective for the intended purpose. In general, good results have been obtained with amounts of from about 1 to about 10 $g/m^2$ when coated on a support. In a preferred embodiment of the invention, the dye receiving layer comprises a polycarbonate. The term "polycarbonate" as used herein means a polyester of carbonic acid and a glycol or a dihydric phenol. Examples of such glycols or dihydric phenols are p-xylene glycol, 2,2-bis(4-oxyphenyl)propane, bis(4-oxyphenyl)methane, 1,1-bis(4-oxyphenyl)ethane, 1,1-bis(oxyphenyl)butane, 1,1-bisphenol-A polycarbonate having a number average molecular weight of at least about 25,000 is used. Examples of preferred polycarbonates include General Electric LEXAN Polycarbonate Resin and Bayer AG MACROLON 5700. Further, a thermal dye transfer overcoat polymer as described in U.S. Pat. No. 4,775,657 may also be used.

Heating times of from about 10 seconds to 30 minutes at temperatures of from about 50° to 200° C. (more preferably 75° to 160° C., and most preferably 80° to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75° to 190° C. Particularly useful methods of heating and stripping are described by Texter et al. in U.S. Pat. No. 5,164,280 and by Lynch and Texter in U.S. application Ser. No. 07/858,726, the disclosures of which are incorporated herein in their entireties.

Stripping Layers

Stripping layers are included in preferred embodiments to facilitate the mechanical separation of receiver layers and mordant layers from donor layers and diffusible dye forming layers. Stripping layers are usually coated between a dye receiving layer and one or more diffusible dye-forming layers. Stripping layers may be formulated essentially with any material that is easily coatable, that will maintain dimensional inegrity for a sufficient length of time so that a suitable image may be transferred by dye diffusion there through with sufficiently adequate density and sharpness, and that will facilitate the separation of donor and receiver components of the photographic element under suitable stripping conditions. Said dimensional stability must be maintained during storage and during the development and dye forming process. In preferred embodiments this dimensional stability is maintained during all wet or aqueous processing steps and during subsequent drying. Various stripping polymers and stripping agents may be used alone and in combination in order to achieve the desired strippability in particular processes with particular photographic elements. The desired strippability in a given process is that which results in clean separation between the image receiving layer(s) and the emulsion and diffusible dye forming layers adhering to the image receiving layer. Good results have in general been obtained with stripping agents coated at level of 3 mg/m$^2$ to about 500 mg/m$^2$. The particular amount to be employed will vary, of course, depending on the particular stripping agent employed and the particular photographic element used, and the particular process employed.

Perfluoronated stripping agents have been disclosed by Bishop et al. in U.S. Pat. No. 4,459,346, the disclosure of which is incorporated herein in its entirety by reference. In a preferred embodiment of our invention, the stripping layer comprises stripping agents of the following formula:

$$CF_3(CF_2)_n-SO_2-\overset{\overset{R_1}{|}}{N}-CH_2R_2$$

wherein $R_1$ is an alkyl or substituted alkyl group having from 1 to about 6 carbon atoms or an aryl or substituted aryl group having from about 6 to about 10 carbon atoms; $R_2$ is $$-\overset{\overset{O}{\|}}{C}-O-(CH_2CH_2O)_x-R_3,$$

$$-\overset{\overset{O}{\|}}{C}-O-(CH_2)_y-R_3, \text{ or}$$

$$-CH_2-O-(CH_2CH_2O)_z-R_3;$$

$R_3$ is H or $R_1$; n is an integer of from about 4 to about 19; x and y each represents an integer from about 2 to about 50, and z each represents an integer of from 1 to about 50. In another preferred embodiment, $R_1$ is ethyl, $R_2$ is $$-\overset{\overset{O}{\|}}{C}-O-(CH_2CH_2O)_x-H,$$

n is about 8, and x is about 25 to 50. In another preferred embodiment, $R_1$ is ethyl, $R_2$is $$-\overset{\overset{O}{\|}}{C}-O-(CH_2)_y-H,$$

n is about 8, and y is about 25 to 50. In another preferred embodiment, $R_1$ is ethyl, $R_2$is $-CH_2O(CH_2CH_2O)_zH$, n is 8 and z is 1 to about 30.

If the process of this invention is used to produce a transparency element for use in high magnification projection, it is desirable to maintain sharpness and to minimize the thickness of the diffusion path. This minimization is achieved in part by using a stripping layer that does not swell appreciably and which is as thin as possible. These requirements are met by the perfluoronated stripping agents herein described. These agents provide clean stripping and do not materially alter the surface properties at the stripping interface. These perfluoronated stripping agents also provide for a stripping layer with weak dry adhesion. A strong dry adhesion makes separation of substantially dry elements difficult.

Preferred stripping agents useful in the process of this invention include the compounds listed in Table 3.

TABLE 3

| Stripping Agents |
|---|
| $C_8F_{17}SO_2-\overset{\overset{CH_2CH_3}{\|}}{N}-CH_2-\overset{\overset{O}{\|}}{C}-O-(CH_2CH_2O)_{40}-H$ |
| SA1 |
| (Fluorad ® FC-431 [3M Company]) |
| $C_8F_{17}SO_2-\overset{\overset{CH_2CH_3}{\|}}{N}-CH_2-\overset{\overset{O}{\|}}{C}-O-(CH_2)_{40}-H$ |
| SA2 |
| (Fluorad ® FC-432 [3M Company]) |
| $C_8F_{17}SO_2-\overset{\overset{CH_2CH_3}{\|}}{N}-(CH_2CH_2O)_{\overline{2-30}}H$ |
| SA3 |
| (Fluorad ® FC-170 [3M Company]) |

The silver halide emulsion employed in the elements of this invention can be either negative working or positive working. Examples of suitable emulsions and their preparation are described in Research Disclosure, Sections I and II and the publication cited therein. Examples of suitable vehicles for the emulsion layers and other layers of elements of this invention are described in Research Disclosure, Section IX and the publications cited therein. The composition of said silver halide is preferably 70 mole percent or greater silver chloride, and most preferably 95 mole percent or greater silver chloride. Increasing the proportion of chloride increases the developability of said silver halide emulsions.

The photographic elements of this invention or individual layers thereof can contain, for example, brighteners (see Research Disclosure, Section V), antifoggants and stabilizers (see Research Disclosure, Section VI), antistain agents and image dye stabilizers (see Research Disclosure, Section VII, paragraphs I and J), light absorbing and scattering materials (see Research Disclosure, Section VIII), hardeners (see Research Disclosure, Section IX), plasticizers and lubricants (see Research Disclosure, Section XII) antistatic agents (see Research Disclosure, Section XIII, matting agents (see Research Disclosure, Section XVI, and development modifiers (see Research Disclosure, Section XXI), reducing agents, and electron transfer agents. It is preferred that the elements of the present invention are devoid of reducing agents and electron transfer agents, so as to provide stability during preprocessing storage against chemical fogging.

Diffusible-Dye Releasing Couplers

Diffusible-dye releasing compounds of any type may be utilized, so long as said diffusible dyes are diffusible at elevated temperature in a hydrophilic colloid such as gelatin and other hydrophilic colloids when said colloids are nominally dry (contain less than 50% by weight water). Preferred are compounds according to formula I Cp—L-Dye (I)

wherein Cp is a coupler radical, L is a divalent linking group, and Dye is a dye radical exhibiting selective absorption in the visible spectrum.

COUPLING RADICALS

Cp may represent a coupler moiety, capable of forming a cyan dye by coupling with an aromatic primary amine developing agent. Couplers which form cyan dyes upon reaction with oxidized color developing agents are described in such representative patents as U.S. Pat. Nos. 2,367,531, 2,423,730, 2,474,293, 2,772,162, 2,801,171, 2,895,826, 3,002,836, 3,034,892, 3,041,236, 3,419,390, 3,476,565, 3,779,763, 3,996,252, 4,124,396, 4,248,962, 4,254,212, 4,296,200, 4,333,999, 4,443,536, 4,457,559, 4,500,635, 4,526,864, and 4,874,689 and in European Patent Application No. 0 283 938 A1, the disclosures of which are incorporated by reference. Preferred coupler moieties Cp which form cyan dyes upon reaction with oxidized color developing agents are of the phenol type (formula C-I) or the naphthol type (formulae C-II and C-III) or of the type C-IV; the asterisk mark indicates the position of the bond to the divalent linking group L in formula (I)

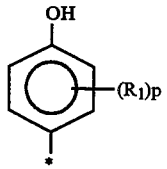

C-I

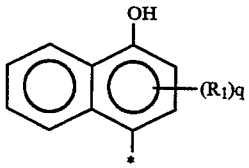

C-II

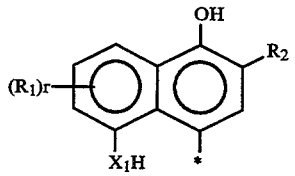

C-III

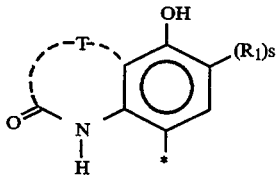

C-IV

In formulae C-I, C-II, C-III, and C-IV above:

$R_1$ has 0 to 30 carbon atoms and represents a possible substituent on the phenol ring or naphthol ring. It is an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group, an arylureido group, hydroxyl group, amino group, carboxyl group, sulfo group, heterocylcic group, carbonamido group, sulfonamido group, carbamoyl group, sulfamoyl group, ureido group, acyloxy group, aliphatic oxy group, aliphatic thio group, aliphatic sulfonyl group, aromatic oxy group, aromatic thio group, aromatic sulfonyl group, sulfamoyl amino group, nitro group, or imido group.

$R_2$ represents —$CONR_3R_4$, —$NHCOR_3$, —$NHCOOR_5$, $NHSO_2R_5$, —$NHCONR_3R_4$, or $NHSO_2R_3R_4$, $R_3$ and $R_4$ each represent a hydrogen atom, aliphatic group having 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-t-amylphenoxy-propyl, and 2,4-di-t-amylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_5$ represents an aliphatic group having from 1 to 30 carbon atoms (such as methyl, ethyl, butyl, methoxyethyl, n-decyl, n-dodecyl, and n-hexadecyl), aromatic group having from 6 to 30 carbon atoms (such as phenyl, tolyl, 4-chlorophenyl, and naphthyl), or heterocyclic group (such as 2-pyridyl, 4-pyridyl, and 2-furyl). $R_3$ and $R_4$ may join each other to form a heterocyclic ring (such as morpholine ring, pipetidine ring, and pyrrolidine ring); p is an integer form 0 to 3; q and r are integers from 0 to 4; s is an integer from 0to2.

$X_1$ represents an oxygen atom, sulfur atom, or $R_6N<$ group, where $R_6$represents a hydrogen atom or monovalent group. When $R_6$ represents a monovalent group, it includes, for example, an aliphatic group having from 1 to 30 carbon atoms (such as methyl, ethyl, butyl, methoxyethyl, and benzyl), aromatic group having from 6 to 30 carbon atoms (such as phenyl and tolyl), heterocyclic group having from 2 to 30 carbon atoms (such as 2-pyridyl and 2-pyrimidyl), carbonamido group having from 1 to 30 carbon atoms (such as formamido, acetamido, N-methylacetamido, toluenesulfonamido, and 4-chlorobenzenesulfonamido), imido group having from 4 to 30 carbon atoms (such as succinimido), —$OR_7$, —$SR_7$, —$COR_7$, —$CONR_7R_8$. —$COCOR_7$, —$COCOR_7R_8$, —$COOR_7$, —COCOOR9, —$SO_2R_9$, —$SO_2OR_9$, —$SO_2NR_7R_8$, or —$NR_7R_8$. $R_7$ and $R_8$, which may be the same or different, each represent a hydrogen atom, aliphatic group having from 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-t-amylphenoxypropyl, and 2,4-di-t-amylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_7$ and $R_8$ may join each other to form a heterocyclic ring (such as morpholine group and piperidine group). $R_9$ may include, for example, those substituents (excluding a hydrogen atom) exemplified for $R_7$ and $R_8$.

T represents a group of atoms required to form a 5-, 6-, or 7-membered ring by connecting with the carbon atoms. It represents, for example $$-O-,\quad -\underset{\underset{R'}{|}}{N}-,\quad -\underset{\underset{O}{\|}}{C}-,\quad -S-,\quad -N=,$$

-continued

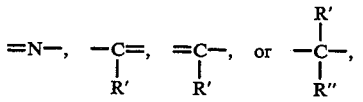

or a combination thereof. In the formulae above, R′ and R″ each represent a hydrogen atom, alkyl group, aryl group, halogen atom, alkyloxy group, alkyloxycarbonyl group, arylcarbonyl group, alkylcarbamoyl group, arylcarbamoyl group or cyano group.

The preferred substituent groups in the present invention are exemplified in the following:

$R_1$ includes a halogen atom (such as fluorine, chlorine, and bromine), aliphatic group (such as methyl, ethyl, and isopropyl), carbonamido group (such as acetamido and benzamido), and sulfonamido (such as methanesulfonamido and toluenesulfonamido).

$R_2$ includes —$CONR_3R_4$ (such as carbamoyl, ethylcarbamoyl, morpholinocarbonyl, dodecylcarbamoyl, hexadecylcarbamoyl, decyloxypropyl, dodecyloxypropyl, 2,4-di-tert-amylphenoxypropyl, and 2,4-di-t-amylphenoxybutyl). $X_1$ includes $R_6N<$, wherein $R_6$ is preferably —$COR_7$ (such as formyl, acetyl, trifluoroacetyl, benzoyl, pentafluorobenzoyl, and p-chlorobenzoyl), —$COOR_9$ (such as methoxycarbonyl, ethoxycarbonyl, butoxycarbonyl, dodecyloxycarbonyl, methoxyethoxycarbonyl, and phenoxycarbonyl), —$SO_2R_9$ (such as methanesulfonyl, ethanesulfonyl, butanesulfonyl, hexadecanesulfonyl, benzenesulfonyl, toluenesulfonyl, and p-chlorobenzensulfonyl), —$CONR_7R_8$ (such as N,N-dimethyl carbamoyl, N,N-diethylcarbamoyl, N,N-dimethylcarbamoyl, N,N-diethylcarbamoyl, N,N-dibutylcarbamoyl, morpholinocarbonyl, piperidinocarbonyl, 4-cyanophenylcarbamoyl, 3,4-dichlorophenylcarbamoyl, and 4-methanesulfonylphenylcarbamoyl, and N,N-dibutylcarbamoyl), and —$SO_2NR_7R_8$ (such as N,N-dimethylsulfamoyl, N,N-diethylsulfamoyl, and N,N-dipropylsulfamoyl). Particularly preferred examples of $R_6$are those groups represented by —$COR_7$, —$COOR_9$, and —$SO_2R_9$.

$R_1$ may be substituted. Preferred substituents are aryl groups (such as phenyl), nitro group, hydroxy group, cyano group, sulfo group, an alkoxy group (such as methoxy), an aryloxy group (such as phenoxy), an acyloxy group (such as acetoxy), an acylamino group (such as aetylamino), an alkylsufonamido group (such as methanesulfonamido), an alkylsulfamoyl group (such as fluorine atom, chlorine atom, bromine atom), carboxyl group, an alkylcarbamoyl group (such as methylcarbamoyl), an alkoxycarbonyl group (such as methoxycarbonyl), an alkylsulfonyl group (such as methylsulfonyl), an alkylthio group (such as β-carboxyethylthio), etc. In the case that said group is substituted by two or more of said substituents, these substituents may be the same or different.

Cp may represent a coupler moiety, capable of forming a magenta dye by coupling with an aromatic primary amine developing agent. Couplers which form magenta dyes upon reaction with oxidized color developing agents are described in such representative patents and publications as U.S. Pat. Nos. 1,969,479, 2,311,082, 2,343,703, 2,369,489, 2,600,788, 2,908,573, 3,061,432, 3,062,653, 3,152,896, 3,519,429, 3,615,506, 3,725,067, 4,120,723, 4,500,630, 4,522,916, 4,540,654, 4,581,326, and 4,874,689, and European Patent Publication Nos. 0 170 164, 177 765, 0 283 938 A1, and 0 316 955 A3, the disclosures of which are incorporated by reference. Preferred magenta couplers include pyrazolones, pyrazolotriazole, and pyrazolobenzimidazole compounds which can form heat transferable dyes upon reaction with oxidized color developing agent. Preferred coupler moieties Cp which form magenta dyes upon reaction with oxidized color developing agents are of the pyrazolotriazole-type and imidazopyrazole-type (formulae M-I to M-VII); the asterisk mark indicates the position of the bond to the divalent linking group L in formula (I)

M-I

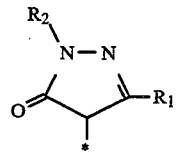

M-II

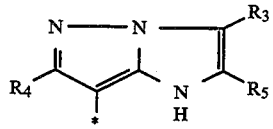

M-III

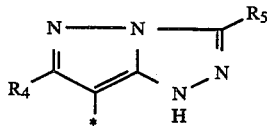

M-IV

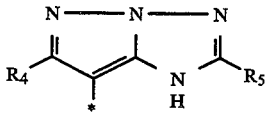

M-V

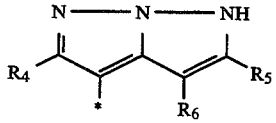

M-VI

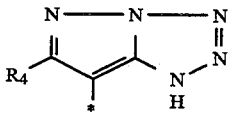

M-VII

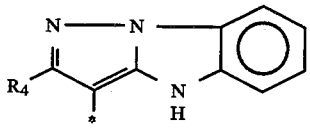

In formulae M-I, M-II, M-III, M-IV, M-V, M-VI, and M-VII above:

$R_1$ and $R_2$ each independently represent a conventional substituent which is well known as a substituent on the 1-position or on the 3-position of a 2-pyrazolin-5-one coupler, such as an alkyl group, a substituted alkyl group (such as a halo-alkyl group, e.g., fluoroalkyl, or cyano-alkyl, or benzyl-alkyl), an aryl group or a substituted arylgroup (e.g., methyl or ethyl substituted), an alkoxy group (such as methoxy or ethoxy), an aryloxy group (such as phenyloxy), an alkoxycarbonyl group (such as methoxy carbonyl), an acylamino group (such as acetylamino), a carbamoyl group, an alkylcarbamoyl group (such as methylcarbamoyl or ethylcarbamoyl), a dialkylcarbamoyl group (such as dimethylcarbamoyl), an arylcarbamoyl group (such as phenylcarbamoyl), an alkylsulfonyl group (such as methylsulfonyl), an arylsulfonyl group (such as phenylsulfonyl), an alkylsulfonamido group (such as methanesulfonamido), an arylsulfonamido group (such as phenylsulfonamido), a sulfamoyl group, an alkylsulfamoyl group (such as ethylsulfamoyl), a dialkylsulfamoyl group (such as dimethylsulfamoyl), an arylsulfamoyl group, an alkylthio group (such as methylthio), an arylthio group (such as phenylthio), cyano group, nitro group, a halogen atom (such as fluorine atom, chlorine atom, bromine atom), etc. In case said group is substituted by two or more of said substituents, these may be the same or different. The most preferred substituents are a halogen atom, an alkyl group, an alkoxy group, an alkoxycarbonyl group, and the cyano group.

$R_3$, $R_4$, $R_5$, and $R_6$ are each independently a hydrogen atom or hydroxyl group, or represent an unsubstituted or substituted alkyl group (preferably having from 1 to 20 carbon atoms, such as methyl, propyl, t-butyl, or trifluoromethyl, tridecyl), an aryl group (preferably having from 6 to 20 carbon atoms, such as phenyl, 4-t-butylphenyl, 2,4-di-t-amylphenyl, or 4-methoxyphenyl), a heterocyclic group (such as 2-furyl, 2-thienyl, 2-pyrimidinyl, or 2-benzthiazolyl), an alkylamino group (preferably having from 1 to 20 carbon atoms, such as methylamino, diethylamino, t-butylamino), an acylamino group (preferably having from 2 to 20 carbon atoms, such as acetylamino, propylamido, benzamido), an anilino group (such as phenylamino, 2-chloroanilino), an alkoxycarbonyl group (preferably having from 2 to 20 carbon atoms, such as methoxycarbonyl, butoxycarbonyl, 2-ethylhexyloxycarbonyl), an alkylcarbonyl group (preferably having from 2 to 20 carbon atoms, such as acetyl, butylcarbonyl, cyclohexylcarbonyl), an arylcarbonyl group (preferably having from 7 to 20 carbon atoms, such as benzoyl, or 4-t-butylbenzoyl), an alkylthio group (preferably having from 1 to 20 carbon atoms, such as methylthio, octylthio, 2-phenoxyethylthio), an arylthio group (preferably having from 6 to 20 carbon atoms, such as phenylthio, 2-butoxy-5-t-octylphenylthio), a carbamoyl group (preferably having from 1 to 20 carbon atoms, such as N-ethylcarbamoyl, N,N-dibutylcarbamoyl, N-methyl-N-butylcarbamoyl), a sulfamoyl group (preferably $NH_2SO_2$ and a group having from 1 to 20 carbon atoms, such as N-ethylsulfamoyl, N,N-diethylsulfamoyl, N,N-dipropylsulfamoyl), or an alkyl sulfonamido group (preferably having from 6 to 20 carbon atoms, such as benzenesulfonamido, p-toluenesulfonamido). Cp may represent a coupler moiety, capable of forming a yellow dye by coupling with an aromatic primary amine developing agent. Couplers which form yellow dyes upon reaction with oxidized color developing agent are described in such representative U.S. Pat. Nos. as 2,298,443, 2,875,057, 2,407,210, 3,265,506, 3,384,657, 3,408,194, 3,415,652, 3,447,928, 3,542,840, 4,046,575, 3,894,875, 4,095,983, 4,182,630, 4,203,768, 4,221,860, 4,326,024, 4,401,752, 4,443,536, 4,529,691, 4,587,205, 4,587,207 and 4,617,256, and in European Patent Applications 259 864 A2, 0 283 938 A1, and 0 316 955 A3, the disclosures of which are incorporated by reference. Preferred yellow dye image forming couplers are acylacetamides, such as benzoylacetanilides and pivalylacetanilides, which can form heat transferable dyes upon reaction with oxidized color developing agent. Preferred coupler moieties Cp which form yellow dyes upon reaction with oxidized color developing agents are of the acylacetanilide type (formula Y-I) and benzoylacetanilide type (formulae Y-II and Y-1II); the asterisk mark indicates the position of the bond to the divalent linking group L in formula (I)

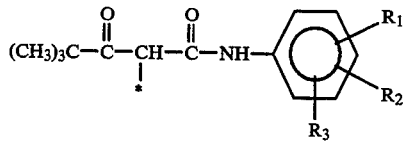
Y-1

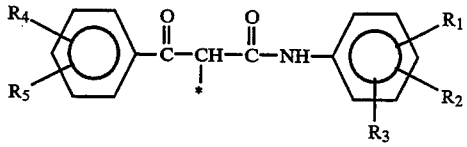
Y-II

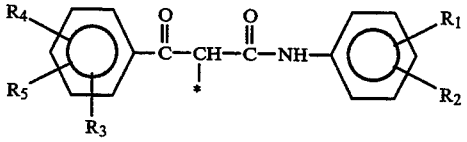
Y-III

In formulae Y-I, Y-II, and Y-III above:

$R_1$, $R_2$, $R_3$, $R_4$, and $R_5$ each independently represents a hydrogen atom or a substituent which is conventional and well known in a yellow coupler group, for example, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group, or thiocyano group.

Cp may represent a coupler moiety, capable of forming a colorless product by coupling with an aromatic primary amine developing agent. Couplers which form colorless products upon reaction with oxidized color developing agent are described in such representative U.S. Pat. Nos. as 3,632,345, 3,928,041, 3,958,993, and 3,961,959, and in United Kingdom Patent No. 861,138, the disclosures of which are incorporated herein by reference. Preferred colorless product forming couplers are cyclic carbonyl containing compounds and have the coupling-off group attached to the carbon atom in the $\alpha$ position with respect to the carbonyl group. Preferred coupling moieties Cp which form colorless products upon reaction with oxidized color developing agents are depicted in formulae W-I–W-IV; the asterisk mark indicates the position of the bond to the divalent linking group L in formula (I):

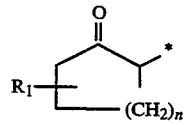
W-I

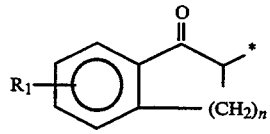
W-II

-continued

W-III

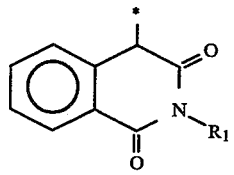

W-IV

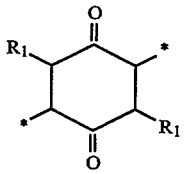

In formulae W-I–W-IV above: $R_1$ represents a ballast group; n is 1 or 2.

Cp may represent a coupler moiety, capable of forming a black dye or a brown dye by coupling with an aromatic primary amine developing agent. Couplers which form black and brown dyes upon reaction with oxidized color developing agent are described in such representative U.S. Pat. Nos. as 1,939,231, 2,181,944, and 2,333,106, and 4126,461, and German OLS Nos. 2,644,194 and 2,650,764, which are incorporated herein by reference. Preferred black and brown dye forming couplers are resorcinols or m-aminophenols and have the coupling-off group attached in the paraposition with respect to the hydroxyl group Preferred coupling moieties Cp which form black dyes and brown dyes upon reaction with oxidized color developing agents are depicted in formulae B-I–BIII; the asterisk mark indicates the position of the bond to the divalent linking group L in formula (I):

B-I

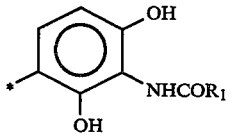

B-II

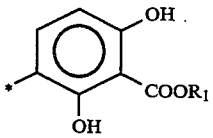

B-III

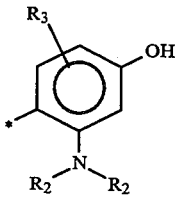

In formulae B-I–B-III above: $R_1$ is alkyl of 3 to 20 carbon atoms, phenyl, or phenyl substituted with hydroxy, halo, amino, alkyl of 1 to 20 carbon atoms or alkoxy of 1 to 20 carbon atoms; each $R_2$ is independently hydrogen, halogen, alkyl of 1 to 20 carbon atoms, alkenyl of 1 to 20 carbon atoms, or aryl of 6 to 20 carbon atoms; $R_3$ is one or more halogen, alkyl of 1 to 20 carbon atoms, alkoxy of 1 to 20 carbon atoms, any other monovalent group.

Any of the foregoing coupler radicals may be ballasted by attachment to a polymer at some position other than the coupling position of said radicals.

LINKING GROUPS

The linking group may be any divalent group that attaches to the coupling position of Cp and to the Dye such that the coupling-off group, comprising the linking group L and the Dye,—L-Dye, is released from the coupler upon reaction of oxidized developer with the coupling moiety and such that the Dye moiety is subsequently released from the coupling-off group. Linking groups suitable for the present invention have been described in U.S. Pat. Nos. 4,248,962, 4,409,323, and 4,840,884, the disclosures of which are incorporated herein by reference. The group L can contain moieties and substituents which will permit control of one or more of the rate of reaction of Cp with oxidized color developing agent, the rate of diffusion of the coupling off group, and the rate of release of Dye.

Preferred linking groups include the following:

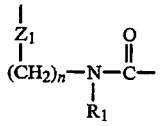

L-2

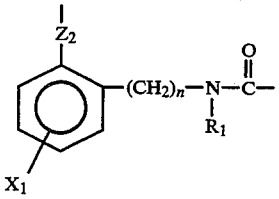

where n is 0 or 1;

L-3

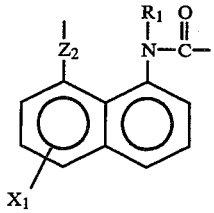

L-4

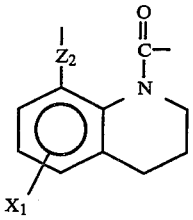

L-5

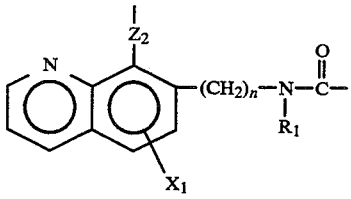

where n is 0 or 1;

-continued

L-6

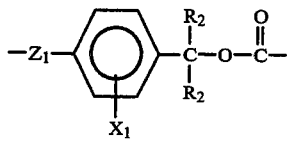

L-7

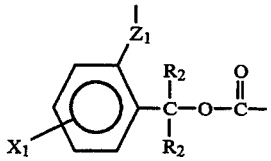

L-8

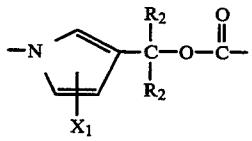

L-9

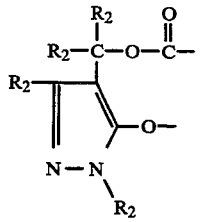

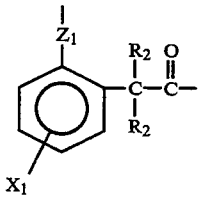

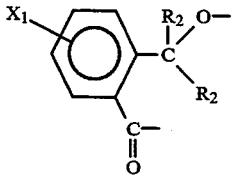

L-10

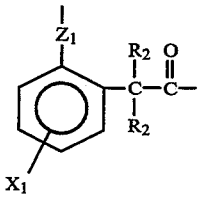

L-11

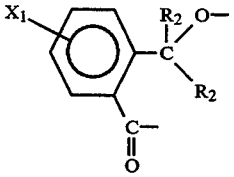

-continued

L-12

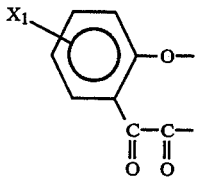

L-13

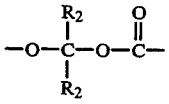

L-14

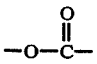

wherein $Z_1$ is 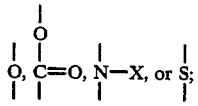

where X is a substituent;

$Z_2$ is 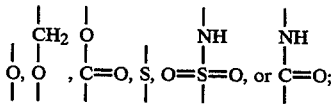

$R_1$ is hydrogen, alkyl of 1 to 20 carbon atoms, preferably lower alkyl of 1 to 4 carbon atoms, or aryl of 6 to 30 carbon atoms, preferably aryl of 6 to 10 carbon atoms;

each $R_2$ independently is hydrogen, alkyl of 1 to 25 carbon atoms, preferably lower alkyl of 1 to 4 carbon atoms, cycloalkyl, substituted cycloalkyl, or aryl of 6 to 30 carbon atoms, preferably aryl of 6 to 10 carbon atoms;

$X_1$ is hydrogen, cyano, fluoro, chloro, bromo, iodo, nitro, alkyl of 1 to 20 carbon atoms, aryloxy, alkoxycarbonyl, hydroxy, sulfonyl, acyl, alkoxy, sulfo, $—OR_2$, $—COOR_2$, $—CONHR_2$, $—NHCOR_2$, $—NHSO_2R_2$, $—SO_2NHR_2$, or $—SO_2R_2$.

The following are suitable examples of these preferred linking groups:

LK-1

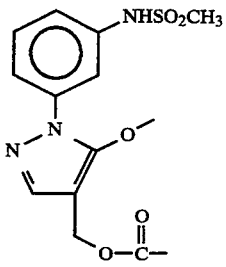

LK-2

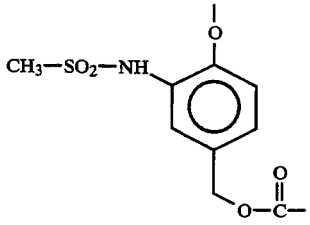

-continued

LK-3

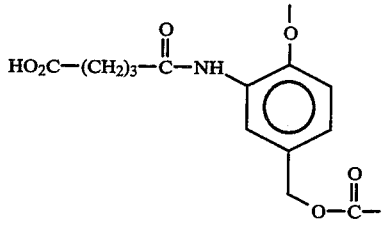

LK-4

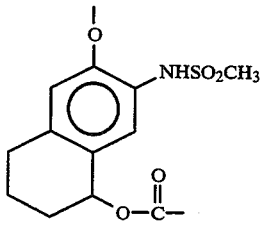

LK-5

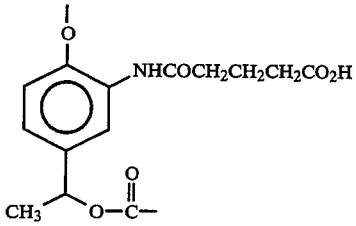

LK-6

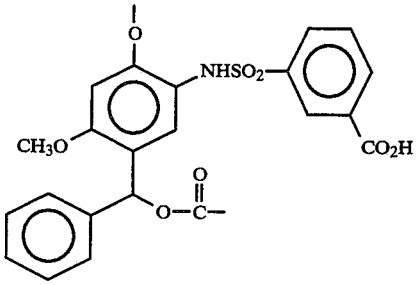

-continued

LK-7

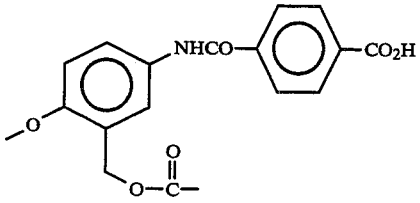

LK-8

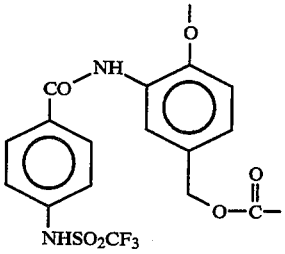

DYE RADICALS

The Dye moiety may be any diffusible dye or diffusible-dye precursor including azo, azamethine, azopyrazolone, indoaniline, indophenol, anthraquinone, triarylmethane, alizarin, nitro, quinoline, or phthalocyanine dyes or precursors of such dyes such as leuco dyes or shifted dyes. Such dyes are described for example in U.S. Pat. Nos. 3,880,658, 3,931,144, 3,932,380, 3,932,381, 3,942,987, 4,248,962, and 4,840,884, the disclosures of which are incorporated herein by reference.

Preferred dyes and dye precursors are azo, azamethine, and indoaniline dyes and dye precursors. Examples of such dyes include the following; the asterisk denotes the point of attachment of the dye to the divalent linking group L:

DC-1

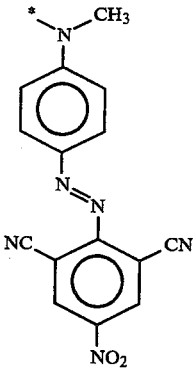

-continued
DC-2
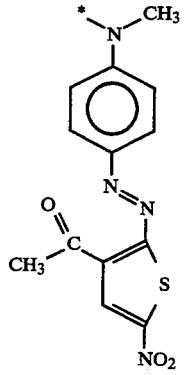
DC-3
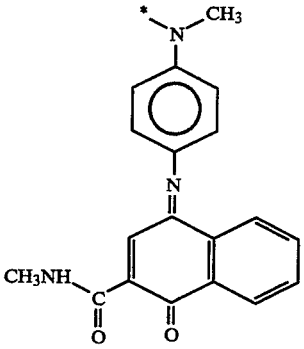
DC-4
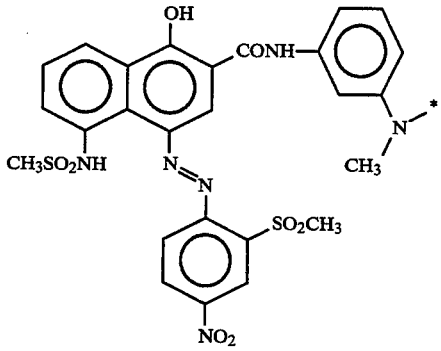
DM-1
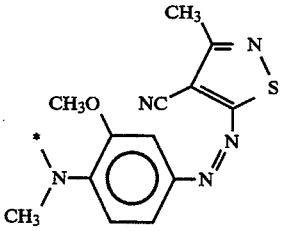
DM-2
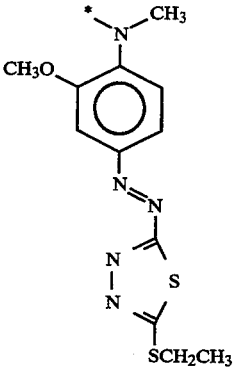

-continued
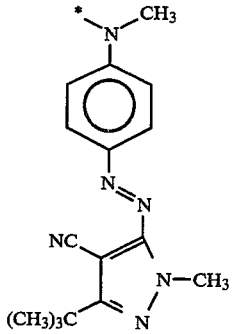
DM-3
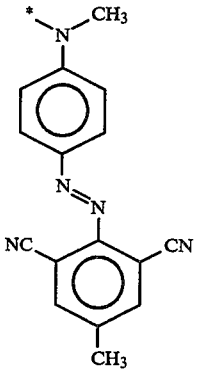
DM-4
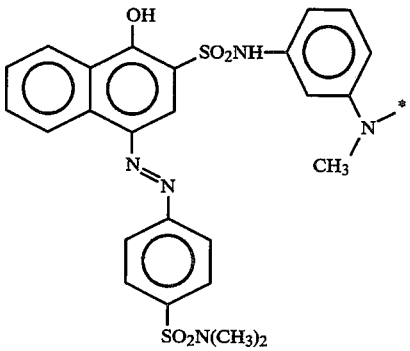
DM-5
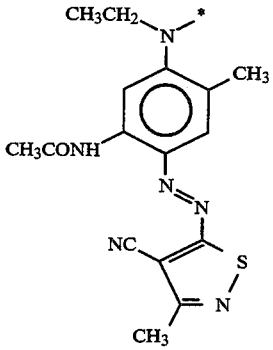
DM-6

-continued
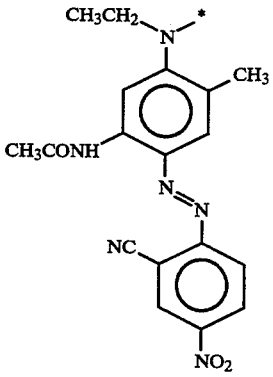
DM-7
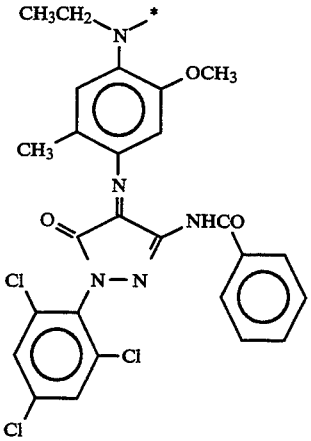
DM-9
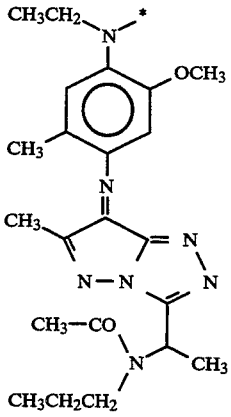
DY-1
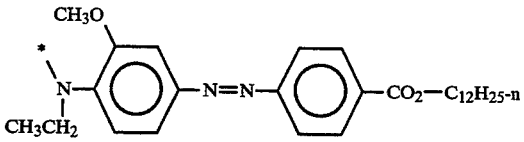
DY-2
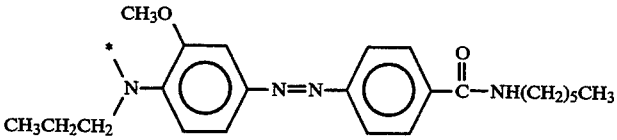
DY-3
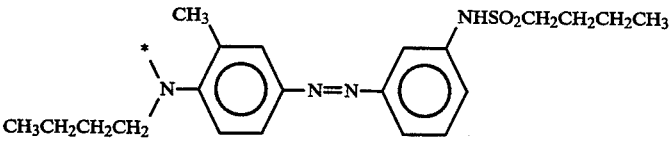

-continued

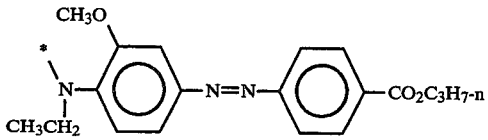

DY-4

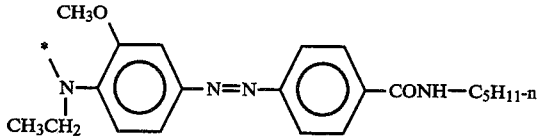

DY-5

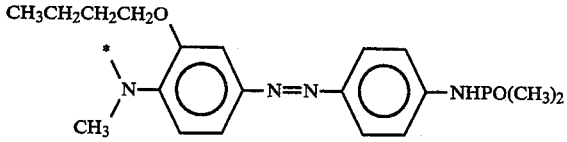

DY-6

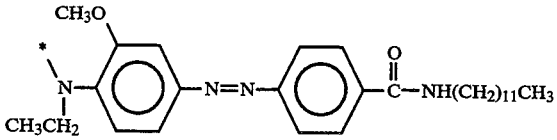

DY-7

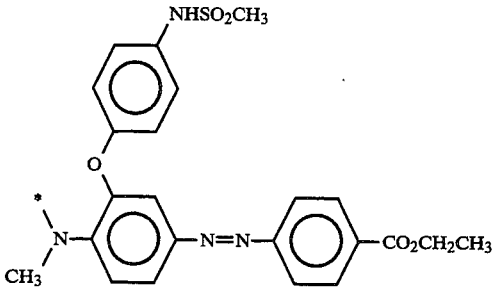

DY-8

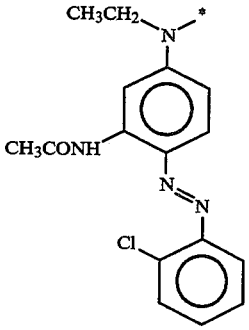

DY-9

Thermal Solvents

Thermal solvents may be added to any layer(s) of the photographic element, including interlayers, imaging layers, and receiving layer(s), in order to facilitate transfer of dye to said receiving layer(s). Preferred thermal solvents have the structure I,

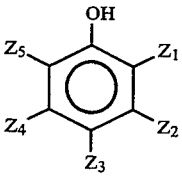

(I)

wherein (a) $Z_1$, $Z_2$, $Z_3$, $Z_4$, and $Z_5$ are substituents, the Hammer sigma parameters of $Z_2$, $Z_3$, and $Z_4$ sum to give a total, $\Sigma$, of at least $-0.28$ and less than 1.53;

(b) the calculated logP for I is greater than 3 and less than 10. Suitable examples of thermal solvents include 3-hydroxy benzoates, 4-hydroxy benzoates, 3-hydroxy benzamides, 4-hydroxy benzamides, 3-hydroxyphenyl acetamides, and 4-hydroxyphenyl acetamides. In a given layer, said thermal solvent is generally added at 1 to 300% by weight of binder in said layer. Preferably, said thermal solvent is generally added at 50 to 120% by weight of binder in said layer.

Suitable examples of said thermal solvents include aryl and alkyl esters of 3hydroxy benzoic acid and of 4-hydroxy benzoic acid, where the aryl and alkyl groups comprise 1-hexyl, cyclohexyl, phenyl, cyclopentylmethyl, 2-hexyl, 3-hexyl, 2-ethyl-1-butyl, 3,3-dimethyl-2-butyl, 2-methyl-1-pentyl, 2-methyl-2-pentyl, 3-methyl-1-pentyl, 4-methyl-2-pentyl, 4-methyl-1-pentyl, 1-heptyl, benzyl, tolyl, 2-methyl-1-phenyl, 3-methyl-1-phenyl, 2,2-dimethyl-3-pentyl, 2,3-dimethyl-3-pentyl, 3-ethyl-2-pentyl, 3-ethyl-3-pentyl, 2-heptyl, 2-methyl-2-hexyl, 3-methyl-2-hexyl, 5-methyl-2-hexyl, 2-methyl-5-hexyl, cycloheptyl, 2-methyl-l-cyclohexyl, 3-methyl-1-cyclohexyl, 4-methyl-1-cyclohexyl, hexahydrobenzyl, 2-ethyl-l-octyl, 1-octyl, 2,2-dimethyl-3-hexyl, 2,3-dimethyl-2-hexyl, 3-ethyl-3-hexyl, 2,4-dimethyl-3-hexyl, 3,4-dimethyl-2-hexyl, 3,5-dimethyl-3-hexyl, 2-methyl-2-heptyl, 3-methyl-5-heptyl, 4-methyl-4-heptyl, 6-methyl-2-heptyl, 2,4,4-trimethyl-2-pentyl, cyclo-hexylethyl, cycloheptylmethyl, 3,5-dimethyl-l-cyclohexyl, 2,6-dimethyl-l-cyclohexyl, 1-nonyl, 2-nonyl, 3-nonyl, 4-nonyl, 5-nonyl, 2-methyl-3-octyl, 2-methyl-4-octyl, 3-methyl-3-octyl, 4-methyl-4-octyl, 4-ethyl-4-heptyl, 2,4-dimethyl-3-heptyl, 2,6-dimethyl-4-heptyl, 1,3-diisobutyl-2-propyl, 2,2,3-trimethyl-3-hexyl, 3,5,5-trimethyl-1-hexyl, 3-cyclo-hexyl-1-propyl, 1-methyl-1-cyclooctyl, 3,3,5-trimethylcyclohexyl, 1-decyl, 2-decyl, 3-decyl, 4-decyl, 5-decyl, 2,2-dimethyl-3-octyl, 4,7-dimethyl-4-octyl, 2,5-dimethyl-5-octyl, 3,7-dimethyl-1-octyl, 3,7-dimethyl-3-octyl, 1-decyl, 2-methyl-4-octyl, 3-methyl-3-octyl, 4-methyl-4-octyl, 4-ethyl-4-heptyl, 2,4-dimethyl-3-heptyl, 2,6-dimethyl-4-heptyl, 1,3-diisobutyl-2-propyl, 2,2,3-trimethyl-3-hexyl, 3,5,5-trimethyl-1-hexyl, 2-methyl-4-octyl, 3-methyl-3-octyl, 4-methyl-4-octyl, 4-ethyl-4-heptyl, 2,4-dimethyl-3-heptyl, 2,6-dimethyl-4-heptyl, 1,3-diisobutyl-2-propyl, 2,2,3-trimethyl-3-hexyl, 3,5,5-trimethyl-1-hexyl, 1-undecyl, 2-undecyl, 5-undecyl, 6-undecyl, 1-dodecyl, 2-dodecyl, 2-butyl-1-octyl, 2,6,8-trimethyl-4-nonyl, cyclododecyl, 1-tridecyl, 1-hexadecyl, 2-hexadecyl, 2-hexyl-1-decyl, or mixtures thereof. Suitable examples also include aryl and alkyl amides of 3-hydroxy benzoic acid and of 4-hydroxy benzoic acid, where the aryl and alkyl groups comprise 1-hexyl, 2-hexyl, 1-methyl-1-pentyl, cyclohexyl, 1-heptyl, 2-heptyl, 4-heptyl, 5-methyl-2-hexyl, 1,4-dimethyl- 1-pentyl, cyclohexylmethyl, 2-methyl- 1-cyclohexyl, 3-methyl- 1-cyclohexyl, 1,1,3,3-tetramethyl-1-butyl, 1-octyl, 1-methyl- 1-heptyl, 2-ethyl-2-hexyl, 2-methyl- 1-heptyl, 6-methyl-2-heptyl, cyclooctyl, 2-cyclohexyl- 1-ethyl, 5-nonyl, 1-nonyl, cyclooctylmethyl, 1-decyl, 2-undecyl, 4-undecyl, 1-dodecyl, cyclododecyl, 2-tridecyl, 1-tetradecyl, or mixtures thereof. Suitable examples also include 3,4,5-trihydroxy-2'-ethyl-1'-hexyl benzoate, 3,4,5-trihydroxy-1'-octyl benzoate, 3,4,5-trihydroxy-2',2'-dimethyl-3'-hexyl benzoate, 3,4,5-trihydroxy-1'-nonyl benzoate, 3,4,5-trihydroxy-1'-decyl benzoate, 1,8-octyl-bis(4'-hydroxy benzoate), 1,8-octyl-bis(3'-hydroxy benzoate), 1,10-decyl-bis(4'-hydroxy benzoate), 1,10-decyl-bis(3'-hydroxy benzoate), 3,7-dimethyl-1,7-octyl-bis(4'-hydroxy benzoate), 1,11-undecyl-bis(4'-hydroxy benzoate), 1,12-dodecyl-bis(4'-hydroxy benzoate), 1,12-dodecyl-bis(3 '-hydroxy benzoate), 1,8-octyl-bis(4'-hydroxy benzamide), 1,8-octyl-bis(3'-hydroxy benzamide), 1,4-cyclohexane-bis(methyl-4'-hydroxy benzamide), 1,4-cyclohexane-bis(methyl-3'-hydroxy benzamide), 1-(methyl-4'-hydroxy benzamide)-4-(methyl-3'-hydroxy benzamide)-cyclohexane, 1,9-nonyl-bis(4'-hydroxy benzamide), 1,10-decyl-bis(4'-hydroxy benzamide), 1,10-decyl-bis(3'-hydroxy benzamide), 1,12-dodecyl-bis(4'-hydroxy benzamide), 1,12-dodecyl-bis(3'-hydroxy benzamide), 3,4-dichloro-5-(1'-heptyl) phenol, 3,4-dichloro-5-(1'-octyl) phenol, 3,4-dichloro-5-(2'-ethyl-1'-hexyl) phenol, 3,4-dichloro-5-(1'-nonyl) phenol, 3,4-dichloro-5-(1'-decyl) phenol, 3,4-dichloro-5-(1'-dodecyl) phenol, 5-hydroxy-di-(1'-hexyl) isophthalate, 5-hydroxy-di-(1'-heptyl) isophthalate, 5-hydroxy-di-(1'-octyl) isophthalate, 5-hydroxy-di-(2'-ethyl-1'-hexyl) isophthalate, 5-hydroxy-di-(1'-nonyl) isophthalate, 5-hydroxy-di-(1'-decyl) isophthalate, 5-hydroxy-di-(1'-undecyl) isophthalate, 5-hydroxy-di-(1'-dodecyl) isophthalate, or mixtures thereof.

Exposure and Development

Photographic elements can be exposed to actinic radiation, typically in the visible region of the spectrum, to form a latent image as described in Research Disclosure, Section XVIII and then processed to form a visible dye image as described in Research Disclosure, Section XIX. Processing to form a visible dye image includes the step of contacting the element with a color developing agent to reduce developable silver halide and oxidizing the color developing agent. Oxidized color developing agent in turn reacts with the coupler to release a diffusible dye. Said contacting of the element with a color developing agent comprises wetting at least the emulsion side of said element with a volume of processing solution that exceeds the swelling volume of the element.

With negative working silver halide, the processing step described above gives a negative image. To obtain a positive (or reversal) image, this step can be preceded by development with a nonchromogenic developing agent to develop exposed silver halide, but not form dye, and then uniformly fogging the element to render unexposed silver halide developable. Alternatively, a direct positive emulsion can be employed to obtain a positive image.

Aqueous development utilizing primary amine reducing agents is typically used. Color developing agents which are useful with the nondiffusing dye-releasing couplers and compounds of this invention include the following:

4-amino-N-ethyl-3-methyl-N-β-sulfoethyl)aniline
4-amino-N-ethyl-3-methoxy-N-(β-sulfoethyl)aniline
4-amino-N-ethyl-N-(β-hydroxyethyl)aniline
4-amino-N,N-diethyl-3-hydroxymethyl aniline
4-amino-N-methyl-N-(β-carboxyethyl)aniline
4-amino-N,N-bis-(β-hydroxyethyl)aniline
4-amino-N,N-bis-(β-hydroxyethyl)-3-methyl-aniline
3-acetamido-4-amino-N,N-bis-(β-hydroxyethyl)aniline
4-amino-N-ethyl-N-(2,3-dihydroxypropoxy)-3-methyl aniline sulfate salt
4-amino-N,N-diethyl-3-(3-hydroxypropoxy)aniline After image formation the element is subjected to a stop and wash bath that may be the same or different. Thereafter, the element is dried. Said stop, wash, or drying steps may be omitted.

Diffusion Dye Transfer

Heating times of from about 10 seconds to 30 minutes at temperatures of from about 50° to 200° C. (more preferably 75 to 160° C., and most preferably 80° to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of 0.1 to 50 cm/sec are preferred to effect transfer at nip pressures of from about 500 Pa to 1,000 kPa and nip temperatures of from about 75° to 190° C. Particularly useful methods of heating and stripping are described by Texter et at. in U.S. Pat. No. 5,164,280 and by Lynch and Texter in U.S. application Ser. No. 07/858,726, the disclosures of which are incorporated herein in their entireties.

The advantages of the present invention will become more apparent by reading the following examples. The scope of the present invention is by no means limited by these examples, however.

EXAMPLES

Preparation of Comparison Examples

Yellow (Y-1) and magenta (M-1) dye-forming couplers described by Willis and Texter in heat image separation systems as disclosed in U.S. application Ser. No. 07/804,877 and yellow CY-2) and magenta (M-2) dye-forming polymeric couplers described by Texter et al. in U.S. application Ser. No. 07/927,691 were utilized as comparisons to the performance of the dye-releasing couplers of the present invention. Y-1 and M-1 were prepared by means well known in the art; suitable methods for their synthesis are described in U.S. Pat. Nos. as 2,298,443, 2,875,057, 2,407,210, 3,265,506, 3,384,657, 3,408,194, 3,415,652, 3,447,928, 3,542,840, 4,046,575, 3,894,875, 4,095,983, 4,182,630, 4,203,768, 4,221,860, 4,326,024, 4,401,752, 4,443,536, 4,529,691, 4,587,205, 4,587,207 and 4,617,256, and in European Patent Applications 0 259 864 A2, 0 283 938 A1, and 0 316 955 A3, and in U.S. Pat. Nos. 1,969,479, 2,311,082, 2,343,703, 2,369,489, 2,600,788, 2,908,573, 3,061,432, 3,062,653, 3,152,896, 3,519,429, 3,615,506, 3,725,067, 4,120,723, 4,500,630, 4,522,916, 4,540,654, 4,581,326, and 4,874,689, and European Patent Publication Nos. 0 170 164, 0 177 765, 0283 938 A1, and 0 316 955 A3.

Y-1

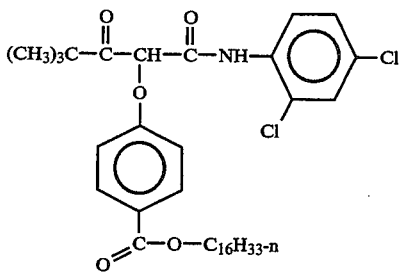

-continued

M-1

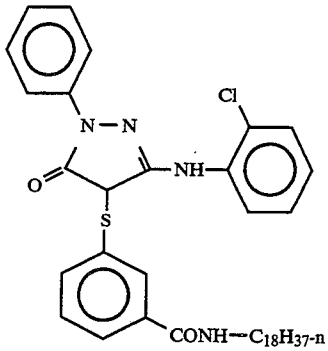

Y-2 and M-2 were prepared as described by Texter et at. in U.S. application Ser. No. 07/927,691 on page 33, line 7 through page 35, line 14 and on page 47, line 10 through page 49, line 25.

Y-2

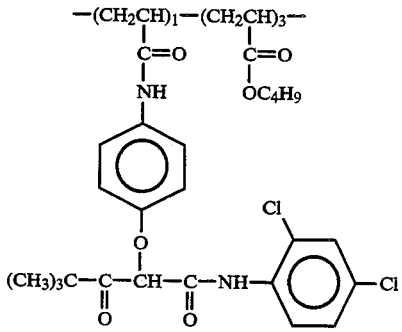

M-2

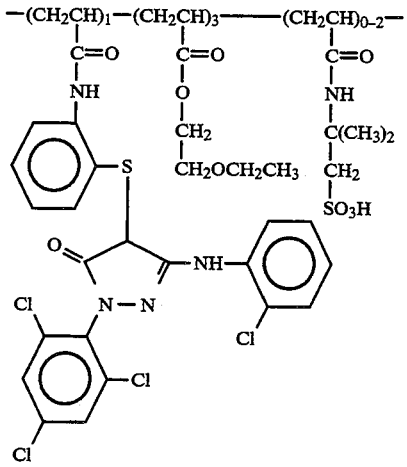

Preparation of Invention Examples

The preparation of dye-releasing coupler Y-7 is described below. Dye-releasing couplers Y-3, Y-4, Y-5, and Y-6 were prepared similarly, except that appropriate alkyl amines were used to prepare the dye radical intermediates and a different conventional coupler was used in the preparation of Y-3 and Y-4.

Y-3
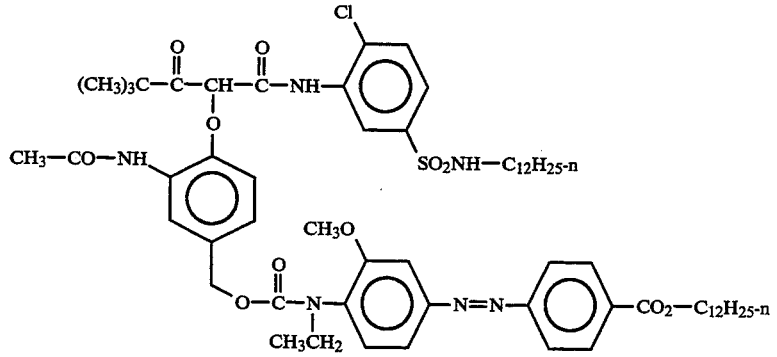
Y-4
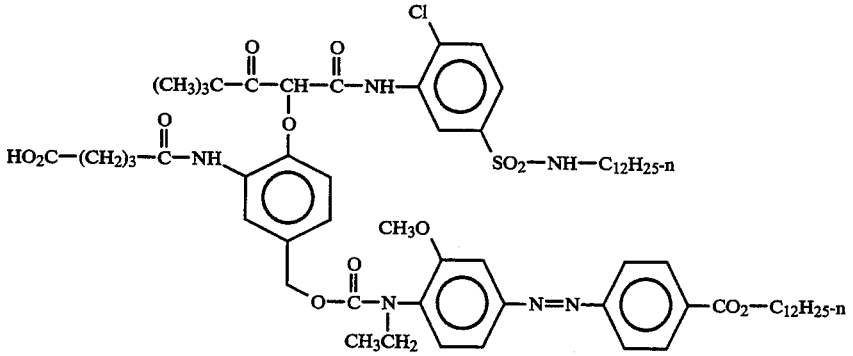
Y-5
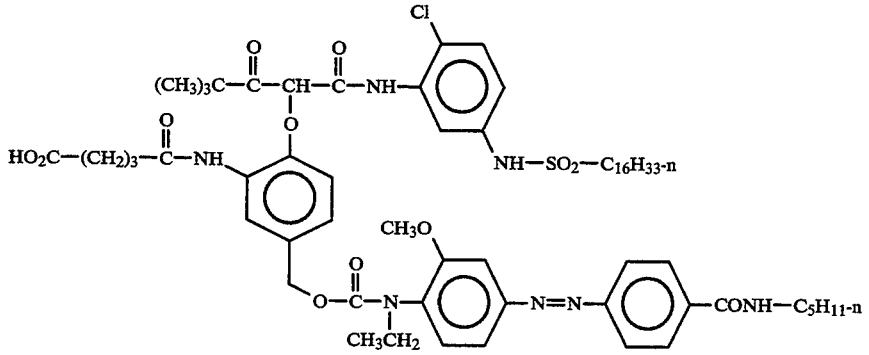
Y-6
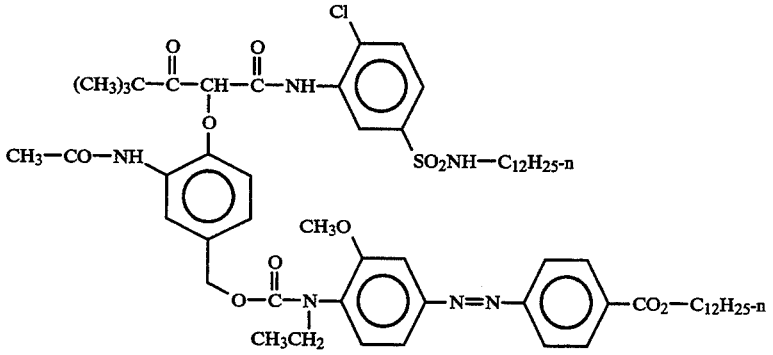
Preparation of Dye-Releasing Coupler Y-7

-continued

Y-7

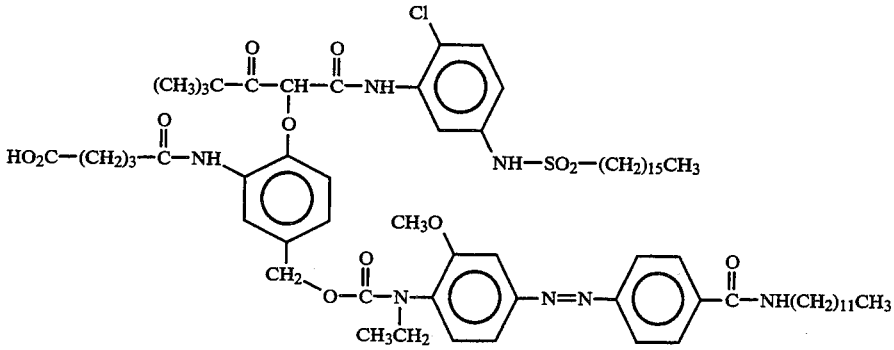

The overall scheme for the synthesis of dye-releasing coupler Y-7 is illustrated below in Scheme 1. The intermediate i-1 in the linking group synthesis was prepared from glutantic anhydride (22.8 g, 0.2 mole), anisyl alcohol (27.6 g, 0.2 mole), and diisopropylethylamine (24.4 mL, 0.2 mole). These reagents were stirred in 80 mL of tetrahydrofuran (THF) at 40° C. for 30 minutes. Intermediate i-1 was not isolated. The mixture was then cooled to 0° C., and 26.2 mL (0.2 mole) isobutyl chloroformate in 60 mL THF was added over 1-2 minutes. This mixture was stirred at 0° C. for 60 minutes to give i-2. This mixture was added slowly over 3-4 minutes to a solution of 3-amino-4-hydroxy benzyl alcohol (13.9 g, 0.22 mole) in 160 mL pyridine cooled to 0° C. The reaction mixture was stirred for an additional 10 minutes and then poured into a separatory funnel containing 500 mL of ethyl acetate, 400 mL of brine, 1000 mL of 2N HCl, and 100 g of ice. The aqueous layer was separated and extracted with 200 mL of ethyl acetate. The combined ethyl acetate layers were washed with 200 mL of Scheme 1

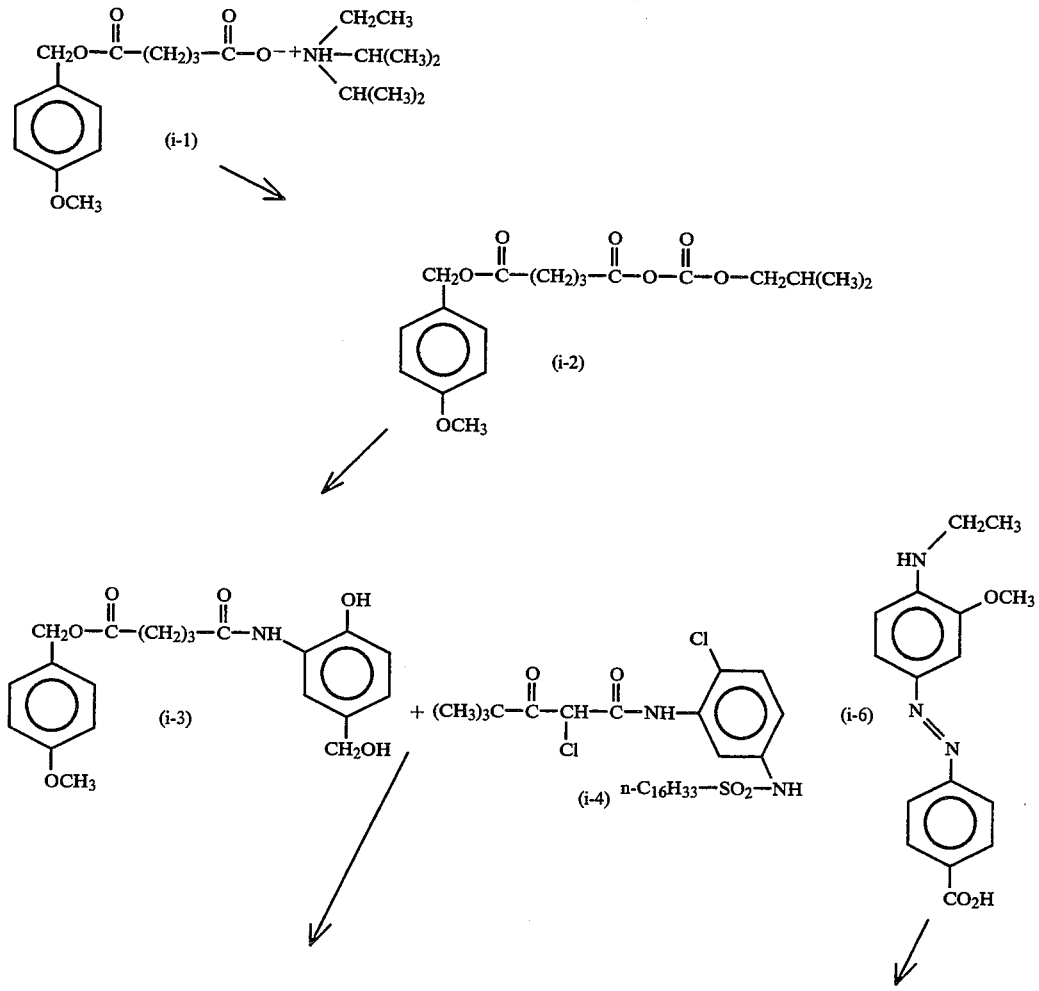

-continued

Scheme 1

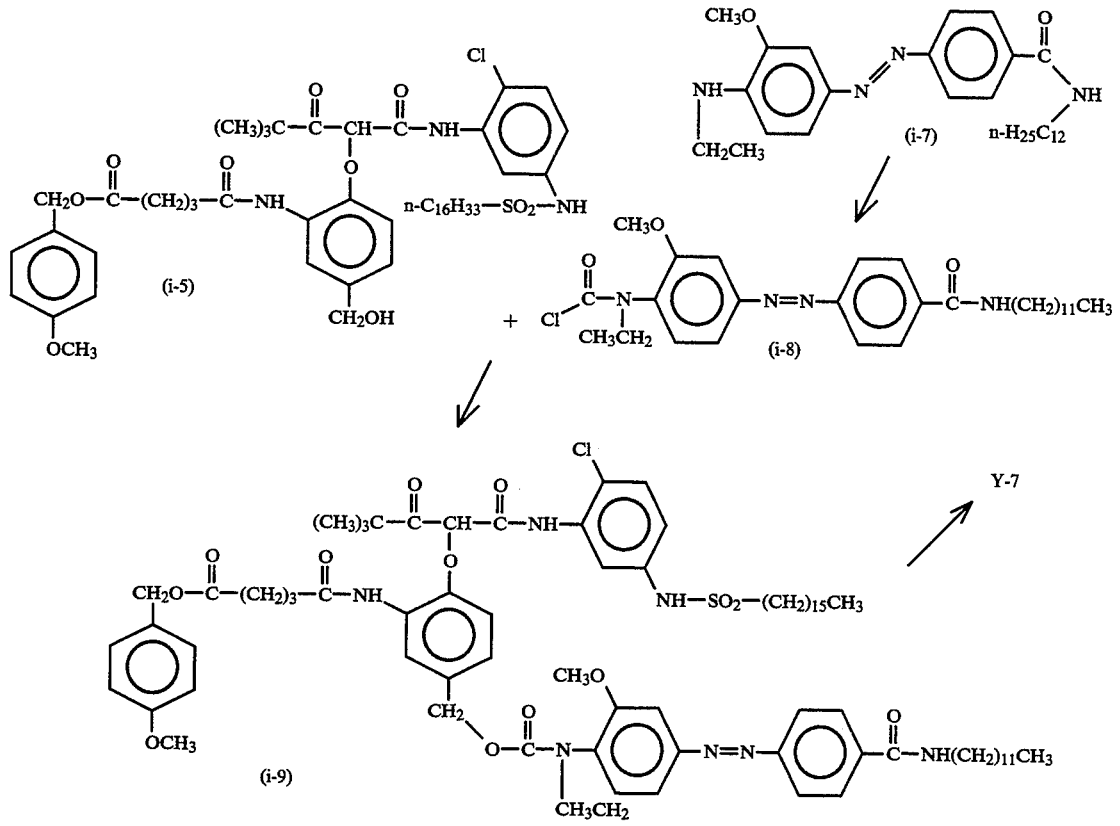

brine, washed with 400 mL of 0.5N $NaHCO_3$, washed with 100 mL of brine, and dried over $Na_2SO_4$. This ethyl acetate solution was filtered, and then concentrated to a yellowish oil in vacuo at less than 30° C. The resulting oil was stirred with about 400 mL of anhydrous ether overnight at room temperature. White crystals began forming in about 15 minutes. The ether mixture was then cooled, and the white solid was collected, washed with cold ether, and air dried to yield 51.7 g of crude i-3. This crude was reslurried in about 400 mL of dry ether and reisolated to yield about 50 g of i-3.

The linking-group precursor i-3 was then attached to the coupler i-4. Coupler i-4 (59.2 g, 0.1 mole) was dissolved in 250 mL of dry dimethylformamide (DMF) warmed to about 30° C. with a water bath to effect dissolution. This solution was kept under nitrogen. The phenol i-3 (37.35 g, 0.1 mole) was then added to the reaction mixture and the solution was cooled to about 20° C. with a cold water bath. A solution of tetramethylguanidine CFMG; 12.52 mL in 45 mL DMF) was added dropwise over about 20 minutes to the reaction, which was kept under nitrogen and maintained at 20°-25° C. After 1 hour 1.64 mL of TMG was added. After about 2 hours the mixture was quenched into a water/ethyl acetate mixture and the pH was adjusted to about 4 with an acetic acid/10% HCl mixture. The ethyl acetate layer was washed twice with water, dried over Na2$SO_4$, and concentrated in vacuo at 30° C. to give the crude product i-5. This crude was dissolved in about 200 mL of 1:1 ethyl acetate/heptane, and this solution was layered on a three liter silica column containing about 1500 g of silica. The product was eluted with increasingly concentrated ethyl acetate and concentrated in vacuo at 30° C. to give 48.8 g of i-5.

Synthesis of the carbamoyl chloride i-8 commenced with the dye i-6. The dye i-6 (44.3 g, 0.148 mole) was dissolved in about 350 mL THF and 20.8 mL (14.99 g) of triethylamine was added. The reaction was cooled to 0° C. in an ice/acetone bath. Ethyl chloroformate (6.98 g, 14.04 mL) was added dropwise, and the reaction mixture was then stirred for 30 minutes. Dodecylamine (27.5 g in 50 mL of THF) was added rapidly, and the reaction mixture was slowly allowed to come to room temperature and was stirred overnight. An equal volume of ethyl acetate was added to the reaction solution and the mixture was washed three times with 1N $NaHCO_3$, washed once with 1% HCl and brine, stripped to dryness, triturated with 400 mL of hot methanol, and cooled. The solids were collected and redissolved in an ethyl acetate/1'HF mixture, washed three times with about 300 mL of 5% $NaHCO_3$, washed once with 1% HCl and brine, dried over $MgSO_4$, and stripped to yield about 30 g of solid. This solid was recrystallized from 350 mL of methanol to yield 28.2 g of i-7. Intermediate i-7 (27.2 g, 0.0583 mol) and lutidine (6.24 g, 0.0583 mole) were dissolved in about 350 mL of methylene chloride and cooled in an ice water bath. Phosgene (28.8 mL of 1.93M in toluene) was added dropwise, the reaction was slowly allowed to come to room temperature and the reaction was stirred overnight. The mixture was washed with about 300 mL of cold 5% HCl, dried over $MgSO_4$, filtered, and stripped to an oil. This oil was slurried with heptane to give an orange solid. This solid was collected and air dried to yield 29.88 g of i-8.

Coupler i-5 (49.5 g, 0.053 mole), dye intermediate i-8 (28 g, 0.053 mole), and dimethylaminopyridine (DMAP; 6.46 g) were stirred in 200 mL of methylene chloride at room temperature. 1,8-Diazabicyclo[5.4.-0]undec-7-ene (DBU; 16.1 g, 15.83 mL) was added dropwise over 15 minutes, and the reaction was stirred at room temperature for 4 hours. This solution was washed with cold 0.2N HCl until the wash turned acidic. The solution was then dried over $MgSO_4$ and stripped to an orange oil, yielding about 78 g of crude product. This crude was dissolved in 100 mL of methylene chloride and chromatographed on a 3 liter silica column using heptane/ethyl acetate mixtures as eluent. Heptane to ethyl acetate was varied from 2:1 to 1:1 in the elution. The product fractions were combined and stripped to yield 32.8 g of i-9 as a foaming solid. About 32 g (0.0225 mole) of i-9 was dissolved in 190 mL of methylene chloride at room temperature. Trifluoroacetic acid (37.5 mL) was added dropwise over 5 minutes, and the reaction mixture was stirred another 10–15 minutes. The reaction solution was washed twice with 500 mL of cold water, once with 1N $NaHCO_3$ to wash out trifluoroacetic acid, and once with cold 5% HCl. The reaction solution was then dried over $MgSO_4$ and stripped to an orange oil. This oil was dissolved in 100 mL of methylene chloride and chromatographed on a 3 liter silica column previously equilibrated with 1:1 ethyl acetaate/heptane. Fast moving yellow impurities were removed by eluting with 1:1 ethyl acetaate/heptane. The product was eluted with 0.5% acetic acid in 1:1 ethyl acetate/heptane. The product fractions were combined and stripped and taken up into ethyl acetate. This solution was washed with 5% $NaHCO_3$, with 5% HCl, dried over $MgSO_4$, and stripped to yield 22.8 g of Y-7 as a foaming yellow solid.

Preparation of Dye-Releasing Coupler C-1

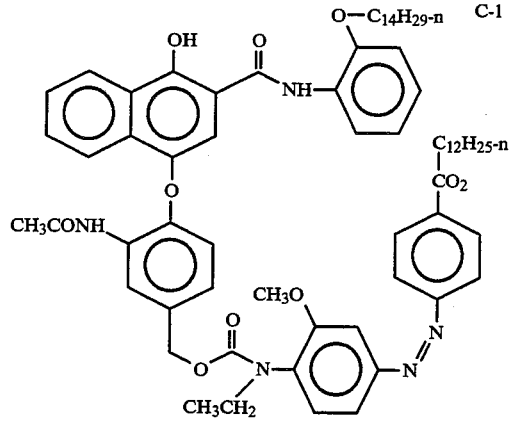

The overall reaction sequence for preparation of dye-releasing coupler C-1 is illustrated below in Scheme 2. A solution of intermediate i-10 (CAS Registry No. 137993-30-7; 6.12 g) and N,N-dimethylaniline (2.0 g) in THF (100 mL) was treated with acetyl chloride (0.75 mL). After stirring for 10 minutes at ambient temperature this mixture was poured into dilute cold aqueous HCl. The solid was collected by filtration, air dried, and recrystallized from acetonitrile to afford i-11 as a tan solid (5.9 g).

Scheme 2

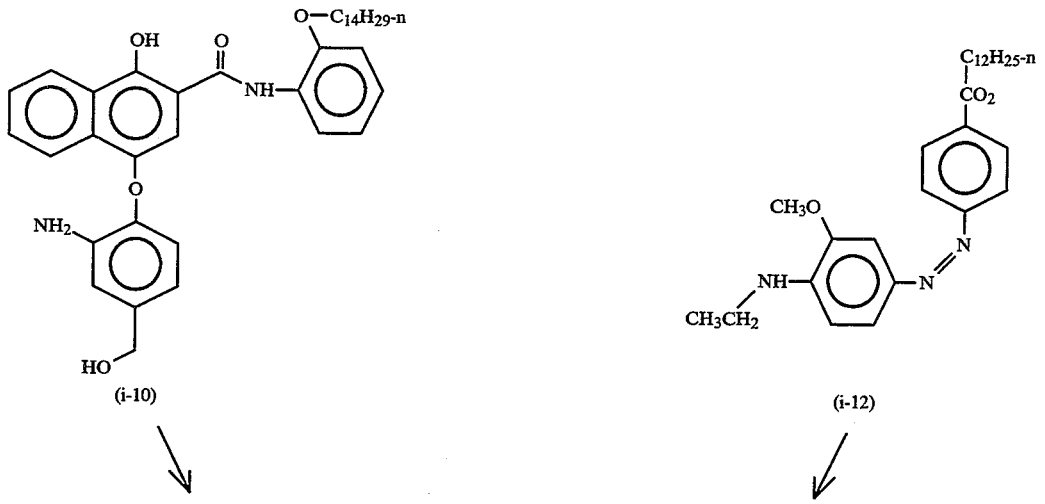

-continued

Scheme 2

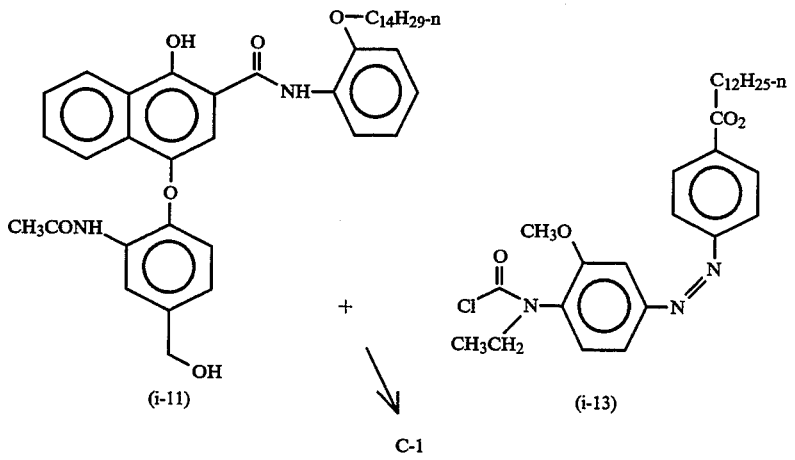

A mixture of i-12 (CAS Registry No. 122328-01-2; 11.7 g), N,N-dimethylaniline (5.0 mL), and triphosgene (3.0 g) in methylene chloride (100 mL) was stirred at ambient temperature. An additional portion of triphosgene (1.5 g) was added to the mixture. After about 30 minutes the reaction mixture was washed with cold dilute aqueous HCl, dried, and concentrated in vacuo to afford the crude i-13. A mixture of this crude i-13 (5.32 g) and i-11 (5.94 g) in DMF (20 mL) and methylene chloride (20 mL) was treated at ambient temperature with 4-dimethylaminopyridine (DMAP; 1.11 g). After stirring for 10 minutes, DBU (3.0 mL) was added. After stirring 2 hours at ambient temperature an additional portion of DBU (1.5 mL) was added to the reaction mixture. After an hour the mixture was poured into cold dilute HCl. Extraction of the reaction mixture with methylene chloride afforded an oil. Silica gel chromatography, eluting with mixtures of ethyl acetate and toluene, gave C-1 as a red oil. Trituration with cyclohexane and ligroin provide C-1 as a red-orange solid (4.17 g).

Preparation of Dye-Releasing Coupler C-2

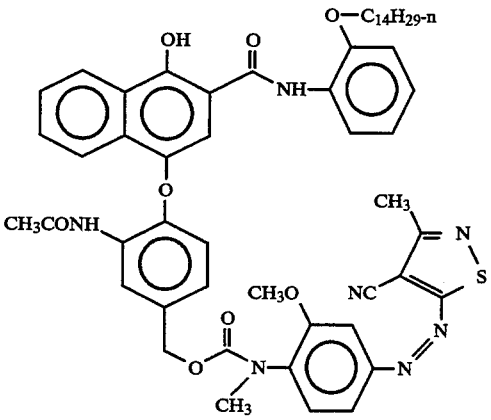

C-2

The scheme for preparing C-2, illustrated below in Scheme 3, differs from that in Scheme 2 only in the preparation of the dye. The preparation of i-13 is as described above. The magenta dye was prepared by dissolving the isothiazole i-14 (CAS Registry No. 041808-35-9; 13.9 g) in concentrated sulfuric acid (100 mL). After cooling to 0° C. a 5:1 (v/v) mixture of acetic to propionic acids (100 mL) was added to the reaction mixture. This mixture at 0° C. was treated with nitrosyl sulfuric acid (40%; 17 mL). After 30 minutes at 0° C. the syrup was added to a well stirred solution of N-methyl-o-anisidine (CAS Registry No. 010541-8-3) in 2% aqueous sulfuric acid. After stirring for 30 minutes the slurry was extracted with ethyl acetate, to afford a dark solid after concentration. Trituration of this solid with methanol followed by filtration afforded dye i-15 as a crude dark solid (16.9 g). The dye carbamyl chloride i-16 and crude C-2 were obtained using methods similar to those described earlier in the preparation of i-13 (Scheme 2) and C-1. C-2 was thus obtained as a yellow solid after trim ration of the crude product.

Dispersions and Coatings

Thermal solvent dispersions were prepared according to the following procedure: An aqueous solution was prepared at about 50° C. by combining 3.75 g of 10% (w/w) aqueous Alkanol XC (Du Pont), 30 g of 12.5% (w/w) gelatin, and 78.75 g water. About 12.5 g of 2'-ethylhexyl-4-hydroxy benzoate was added to this solution with stirring, and this coarse emulsion was then passed through a colloid mill five Scheme 3

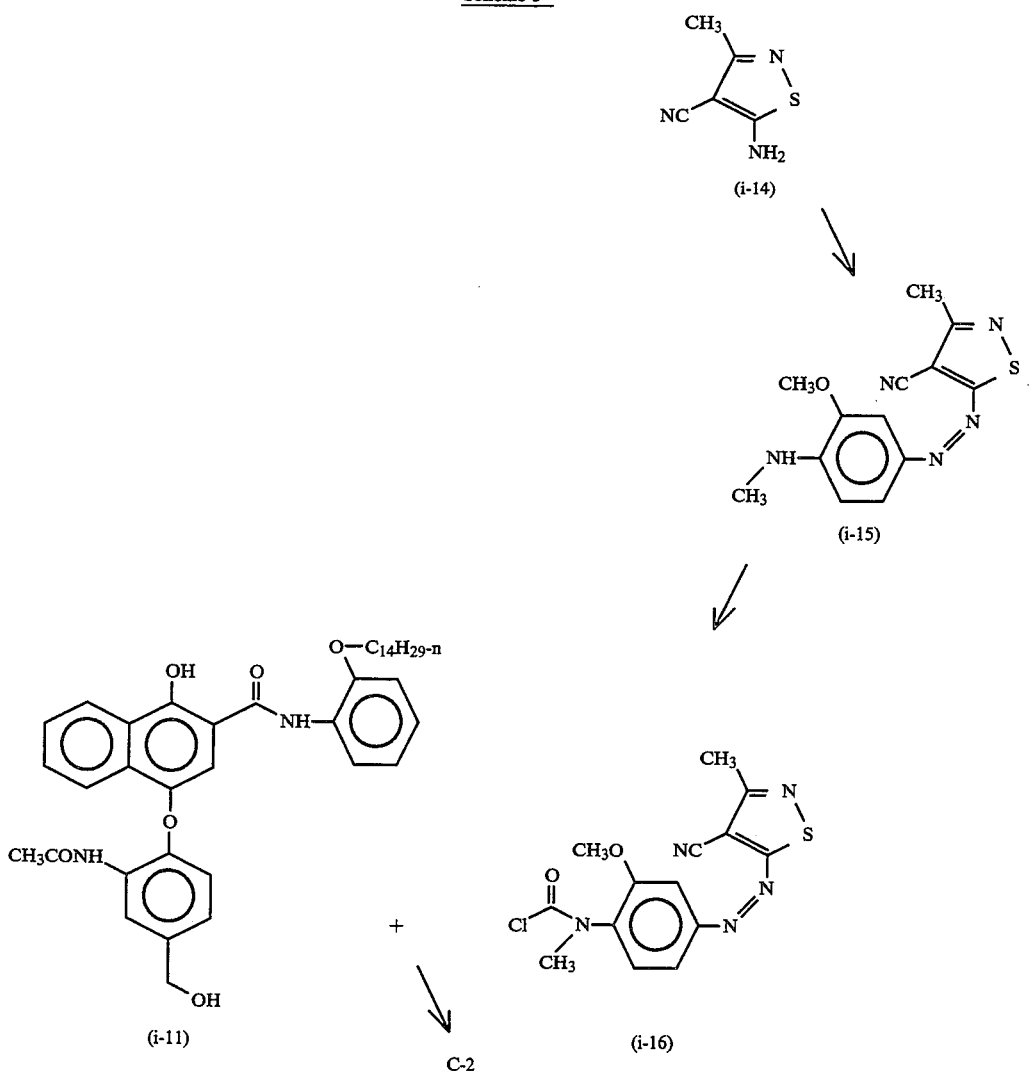

times to produce a fine particle sized dispersion. This thermal solvent dispersion was then chill set and stored in the cold until used.

Dispersions of the comparison and invention dye-forming and dye-releasing couplers were prepared similarly. For example, a dispersion of the comparison coupler Y-1 was prepared according the following procedure: About 8 g of Y-1 were dissolved in 24 g of ethyl acetate at about 60° C. An aqueous gelatin solution comprising 3.2 g of 10% (w/w) Alkanol-XC (Du Pont). 19.2 g 12.5% (w/w) aqueous gelatin, and 19.2 g water was prepared. These aqueous and ethyl acetate solutions were then combined with stirring and passed through a colloid mill five times to obtain a fine particle dispersion of Y-1. The resulting dispersion was chill set, noodled, and washed for about 4 h to remove the ethyl acetate. This dispersion was then remelted, chill set, and stored in the cold until used. Similarly, a dispersion of M-1 was prepared by dissolving 20 g of M-1 in about 60 g of ethyl acetate, and combining this solution with an aqueous solution comprising 6 g of 10% (w/w) Alkanol-XC. 48 g 12.5% (w/w) aqueous gelatin, and 66 g water. This mixture was stirred and then passed through a colloid mill five times to obtain a fine particle dispersion of M-1. The resulting dispersion was chill set, noodled, washed for about 4 h to remove the ethyl acetate, remelted, chill set, and stored in the cold until used. A dispersion of Y-3 was prepared by mixing a solution comprising 2.4 g of Y-3 with 4.8 g of ethyl acetate with an aqueous solution comprising 3.2 g of 10% aqueous Alkanol-XC, 25.6 g of 12.5% (w/w) gelatin, and 44 g water. This mixture was passed through a colloid mill five times to obtain a fine particle dispersion of Y-3, and the resulting dispersion was chill set and stored in the cold until used. A dispersion of Y-4 was prepared by mixing a solution comprising 3.2 g of Y-4 with 6.4 g of ethyl acetate with an aqueous solution comprising 3.2 g of 10% aqueous Alkanol-XC, 25.6 g of 12.5% (w/w) gelatin, and 41.6 g water. This mixture was passed through a colloid mill five times to obtain a fine particle dispersion of Y-4, and the resulting dispersion was chill set and stored in the cold until used. Dispersions of Y-5 and Y-7 were prepared by mixing solutions comprising 3.2 g of dye-releasing coupler with 6.4 g of ethyl acetate with aqueous solutions comprising 3.2 g of 10% aqueous Alkanol-XC, 19.2 g of 12.5% (w/w) gelatin, and 48 g water. These mixtures were passed through a colloid mill five times to obtain fine particle dispersions of Y-5 and Y-7, and the resulting dispersions were chill set and stored in the cold until used. A dispersion of Y-6 was prepared by mixing a solution comprising 0.86 g of Y-6 with 1.2 g of ethyl acetate with an aqueous mixture comprising 1.6 g of 10% aqueous Alkanol-XC, 6.95 g of 12.5% (w/w) gelatin, 0.89 g thermal solvent, and 24.38 g water. This mixture was passed through a colloid mill three times to obtain a fine particle dispersion of Y-6, and the resulting dispersion was chill set and stored in the cold until used. A dispersion of C-1 was prepared by mixing a solution comprising 0.81 g of C-1 with 1.2 g of ethyl acetate with an aqueous mixture comprising 1.6 g of 10% aqueous Alkanol-XC, 6.95 g of 12.5% (w/w) gelatin, 0.89 g thermal solvent, and 24.43 g water. This mixture was passed through a colloid mill three times to obtain a fine particle dispersion of C-1, and the resulting dispersion was chill set and stored in the cold until used. A dispersion of C-2 was prepared by mixing a solution comprising 0.69 g of C-2 with 1.2 g of ethyl acetate with an aqueous mixture comprising 1.6 g of 10% aqueous Alkanol-XC, 6.95 g of 12.5% (w/w) gelatin, 0.89 g thermal solvent, and 24.55 g water. This mixture was passed through a colloid mill three times to obtain a fine particle dispersion of C-2, and the resulting dispersion was chill set and stored in the cold until used. In these dispersions and coating melts of Y-3, Y-4, Y-5, Y-6, Y-7, C-1, and C-2, the ethyl acetate was removed by evaporation during subsequent coating. The comparison polymeric couplers Y-2 and M-2 were prepared as latexes and stored as aqueous latex suspensions.

The test coating structure comprising several layers is illustrated in Table 4. The dye-receiving layer comprised polycarbonate and polycaprolactam and was coated on titania pigmented reflection paper base. This titania pigmented paper base was resin coated with high density polyethylene, and coated with a mixture of polycarbonate, polycapro-lactone, and 1,4-didecyloxy-2,5-dimethoxy benzene at a 0.77:0.115:0.115 weight ratio respectively, at a total coverage of 3.28 g/m$^2$. This polymeric dye-receiving layer was subjected to a corona discharge bombardment within 24 h prior to coating the test elements. The imaging layer contained gelatin at a coverage of 0.644–2.12 g/m$^2$, thermal solvent (2'-ethylhexyl-4-hydroxy benzoate) at a coverage of about 0.687–1.61 g/m$^2$, and blue sensitized silver chloride at a coverage of about 540 mg/m$^2$ as silver. Coatings of Y-2 contained 0.644 g/m$^2$ of gelatin and 1.07 g/m$^2$ of thermal solvent in the imaging layer. Coatings of M-2 contained 0.687 g/m$^2$ of gelatin and 0.687 g/m$^2$ of thermal solvent in the imaging layer. Coatings of Y-1, Y-6, M-1, C-1, and C-2 contained 1.07 g/m$^2$ of gelatin and 1.07 g/m$^2$ of thermal solvent in the imaging layer. Coatings of Y-3, Y-4, Y-5, and Y-7 contained 2.12 g/m$^2$ of gelatin and 1.61 g/m$^2$ of thermal solvent in the imaging layer. The imaging layer was overcoated with a protective overcoat layer. The overcoat layer contained gelatin at a coverage of about 1.07 g/m$^2$. Hardener, 1,1'-[methylene bis(sulfonyl)]bis-ethene (MBSE), was coated at a level corresponding to 1.5% by weight of the total gelatin coated. Deionized bone gelatin, Type IV, was used.

TABLE 4

| |
|---|
| Overcoat Layer |
| Gelatin (1.07 g/m$^2$) |
| Imaging Layer |
| Blue sensitized AgCl emulsion (0.537 g/m$^2$) |
| Dye-forming or Dye-releasing Coupler (0.856–1.66 mmol/m$^2$) |
| Thermal Solvent (0.687–1.61 g/m$^2$) |

TABLE 4-continued

| |
|---|
| Gelatin (0.644–2.12 g/m$^2$) |
| Dye-Receiving Layer |
| Support |

Processing and Sensitometry

These test coatings were exposed for 0.01 s to a tungsten light source (2850° K.) through a 0–3 density 21-step tablet and developed at 35° C. according to the following procedure. This process comprised development for 45 sec in a large volume of developer solution, a 60 sec stop, a 60 see rinse in a pH 7 buffer, washing in water for 90 sec, all at 35° C., and drying. The developer solution was prepared according to the following composition:

| | |
|---|---|
| Triethanolamine | 12.41 g |
| Phorwite REU (Mobay) | 2.3 g |
| Lithium polystyrene sulfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make one liter | |
| pH 10.04 ± 0.05 at 80° F. | |

After drying the overcoat and imaging (emulsion and dye-releasing) layers comprising the donor element were removed (stripped) from the receiving/base layers (receiver element) using the method described by Texter et al. in U.S. Pat. No. 5,164,280. The emulsion side of the dried and processed test coatings was contacted with the gel subbed (107 mg/m$^2$) side of an ESTAR adhesive element and passed 1, 3, or 10 times at a rate of about 5 mm/s through pinch rollers heated to a surface temperature of 110° C. and held together under a pressure of 20 psi. The receiver elements were then pulled apart from the ESTAR adhesive element, and the donor layers were, thereby, stripped at the imaging layer—receiving layer interface and remained attached to the adhesive element. The donor layers contained undeveloped AgCl, the silver image, most of the unreacted coupler, and a small fraction of the image dye formed. The receiver elements, on the other hand, retained most of image dye formed during color development. Reflection dye densities in the Dmax regions of the dye receiver elements were then read with a densitometer using status—A filters. Yellow reflection densities were read for Examples 1–24, and magenta reflection densities were read for Examples 25–33. These values are listed below in Table 5 for Examples 1–33 and illustrate that excellent dye-diffusion transfer may be obtained in the elements of this invention. The Dmax/CL (OD/-mmol/m$^2$) values in column 6 of Table 5 indicate the transferred Dmax obtained per molar amount per unit area of dye releasing coupler (invention examples) or comparison coupler coated. The invention examples of yellow dye releasing couplers Y-3, Y-4, Y-5, C-1, Y-6, and Y-7 all yield Dmax/CL values 150% or more of those for the comparison couplers Y-1 and Y-2. Similarly, the invention example C-2 of a magenta dye releasing coupler yielded Dmax/CL values equivalent to or greater than those of the comparison magenta dye forming couplers M-1 and M-2.

TABLE 5

| Example | Coupler (eq. wt.) | Coupler Level (CL) (mmol/m$^2$) | Heat Treatment (Passes) | Dmax (OD) | Dmax/CL (OD/mmol/m$^2$) |
|---|---|---|---|---|---|
| | | Dye Transfer Densities | | | |
| 1 | Y-1 (648.6) | 1.32 | 1 | 0.47 | 0.35 |
| 2 | Y-1 (648.6) | 1.32 | 3 | 0.58 | 0.44 |
| 3 | Y-1 (648.6) | 1.32 | 10 | 0.61 | 0.46 |
| 4 | Y-2 (834) | 1.66 | 1 | 1.46 | 0.88 |
| 5 | Y-2 (834) | 1.66 | 3 | 1.58 | 0.95 |
| 6 | Y-2 (834) | 1.66 | 10 | 1.65 | 0.99 |
| 7 | Y-3 (1120) | 0.959 | 1 | 1.97 | 2.05 |
| 8 | Y-3 (1120) | 0.959 | 3 | 2.00 | 2.09 |
| 9 | Y-3 (1120) | 0.959 | 10 | 1.95 | 2.03 |
| 10 | Y-4 (1246) | 0.957 | 1 | 1.91 | 2.00 |
| 11 | Y-4 (1246) | 0.957 | 3 | 1.92 | 2.01 |
| 12 | Y-4 (1246) | 0.957 | 10 | 1.90 | 1.99 |
| 13 | Y-5 (1203) | 0.959 | 1 | 1.92 | 2.00 |
| 14 | Y-5 (1203) | 0.959 | 3 | 1.90 | 1.98 |
| 15 | Y-5 (1203) | 0.959 | 10 | 1.88 | 1.96 |
| 16 | Y-7 (1301) | 0.959 | 1 | 1.74 | 1.81 |
| 17 | Y-7 (1301) | 0.959 | 3 | 1.90 | 1.98 |
| 18 | Y-7 (1301) | 0.959 | 10 | 1.91 | 1.99 |
| 19 | C-1 (1149) | 0.856 | 1 | 0.71 | 0.83 |
| 20 | C-1 (1149) | 0.856 | 3 | 1.27 | 1.48 |
| 21 | C-1 (1149) | 0.856 | 10 | 1.30 | 1.65 |
| 22 | Y-6 (1210) | 0.857 | 1 | 1.41 | 1.65 |
| 23 | Y-6 (1210) | 0.857 | 3 | 1.57 | 1.83 |
| 24 | Y-6 (1210) | 0.857 | 10 | 1.52 | 1.77 |
| 25 | C-2 (968) | 0.857 | 1 | 1.63 | 1.90 |
| 26 | C-2 (968) | 0.857 | 3 | 1.66 | 1.94 |
| 27 | C-2 (968) | 0.857 | 10 | 1.76 | 2.05 |
| 28 | M-1 (640) | 0.996 | 1 | 1.87 | 1.88 |
| 29 | M-1 (640) | 0.996 | 3 | 1.92 | 1.93 |
| 30 | M-1 (640) | 0.996 | 10 | 1.82 | 1.83 |
| 31 | M-2 (1040) | 0.996 | 1 | 1.78 | 1.79 |
| 32 | M-2 (1040) | 0.996 | 3 | 1.95 | 1.96 |
| 33 | M-2 (1040) | 0.996 | 10 | 1.96 | 1.97 |

The present invention has been described in some detail with particular reference to preferred embodiments thereof. It will be understood that variations and modifications can be effected within the spirit and scope of the present invention.

What is claimed is:

1. An aqueous-developable photographic color diffusion transfer element comprising one and only one dimensionally stable support and one or more layers comprising radiation sensitive silver halide, thermal solvent for facilitating the thermal diffusion of dyes through a hydrophilic binder, a dye-releasing coupler, and hydrophilic binder, wherein said dye is heat diffusible in said binder and thermal solvent, and wherein said dye-releasing coupler is of the structure Cp—L-Dye where Cp is a cyan dye forming radical, magenta dye forming radical, yellow dye forming radical, black dye forming radical, or colorless product forming radical, said Cp being substituted in the coupling position with a divalent linking group, L;

Dye is a dye radical exhibiting selective absorption in the visible spectrum; and where said —L-Dye group couples off upon reaction of said coupler radical with the oxidation product of a primary amine developing agent, and such that the Dye radical is subsequently released from the —L-Dye group;

and wherein said silver halide is greater than 70 mole percent silver chloride, and wherein said element is devoid of any developing agent or electron transfer agent.

2. An element as in claim 1, which in addition contains a dye-receiving layer intermediate said support and said silver halide containing and said dye-releasing coupler containing layers.

3. An element as in claim 2, where said dye-receiving layer comprises polymer selected from the group consisting of poly-carbonates, polyurethanes, polyesters, polyvinyl chlorides, poly(styrene-co-acrylonitrile)s, poly(caprolactone)s and mixtures thereof.

4. An element as in claim 1, where said support is an opaque reflection support.

5. An element as in claim 1, where said support is a transparent support.

6. An element as in claim 2, further comprising a stripping layer intermediate said dye-receiving layer and any layers containing silver halide or dye-releasing coupler.

7. An element as in claim 6, wherein said stripping layer contains a stripping agent.

8. An element as in claim 7, wherein said stripping agent is coated at levels of 3–500 mg/m$^2$.

9. An element as in claim 7, wherein said stripping agent has the following formula:

$$CF_3(CF_2)_n—SO_2—\overset{\overset{R_1}{|}}{N}—CH_2R_2$$

wherein $R_1$ is an alkyl group having from 1 to 6 carbon atoms, a substituted alkyl group having from 1 to 6 carbon atoms, an aryl group having from 6 to 10 carbon atoms, or substituted aryl group having from 6 to 10 carbon atoms; $R_2$ is $$—\overset{\overset{O}{\|}}{C}—O—(CH_2CH_2O)_x—R_3,$$

$$—\overset{\overset{O}{\|}}{C}—O(CH_2)_y—R_3, \text{ or}$$

$$—CH_2—O—(CH_2CH_2O)_z—R_3;$$

$R_3$ is H or $R_1$; n is an integer from 4 to 19; x and y each independently represents an integer of from 2 to 50; and z represents an integer of from 1 to 50.

10. An element as in claim 9, wherein $R_1$ is ethyl, $R_2$ is $$—\overset{\overset{O}{\|}}{C}—O—(CH_2CH_2O)_x—H,$$

n is 6 to 8, and x is 25 to 50.

11. An element as in claim 9, wherein $R_1$ is ethyl, $R_2$ is $$—\overset{\overset{O}{\|}}{C}—O—(CH_2)_y—H,$$

n is 6 to 8, and y is 25 to 50.

12. An element as in claim 1, wherein said silver halide comprises greater than 95 mole percent silver chloride.

13. An element as in claim 2, wherein said dye-receiving layer comprises an ultraviolet filter dye.

14. An element as in claim 1, wherein said binder is selected from the group consisting of gelatin, polyvinylpyrrolidone, and polyvinylalcohol.

15. An element as in claim 1, wherein said binder is gelatin.

16. An element as in claim 1, wherein said thermal solvent is selected from the group consisting of phenols, benzamides, hydroxybenzoates, and hydroxybenzamides.

17. An element as in claim 1, wherein said thermal solvent is present at a thermal solvent-to-binder weight ratio of 0.1 to 2.

18. An element as in claim 1, wherein said coupler moiety comprises at least one of C-I, C-II, C-III, and C-IV:

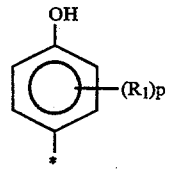

C-I

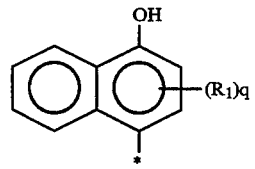

C-II

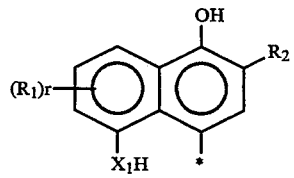

C-III

-continued

C-IV

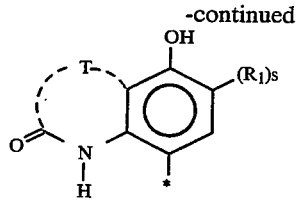

wherein:

$R_1$ has 0 to 30 carbon atoms and is alkyl, alkenyl, alkoxy, alkoxycarbonyl, halogen, alkoxycarbamoyl, aliphatic amido, alkylsulfamoyl, alkylsulfonamido, alkylureido, arylcarbamoyl, arylamido, arylsulfamoyl, arylsulfonamido, arylureido, hydroxyl, amino, carboxyl, sulfo, heterocylcic, carbonamido, sulfonamido, carbamoyl, sulfamoyl, ureido, acyloxy, aliphatic oxy, aliphatic thio, aliphatic sulfonyl, aromatic oxy, aromatic thio, aromatic sulfonyl, sulfamoyl amino, nitro, or imido;

$R_2$ is $-CONR_3R_4$, $-NHCOR_3$, $-NHCOOR_5$, $NHSO_2R_5$, $-NHCONR_3R_4$, or $NHSO_2R_3R_4$, wherein $R_3$ and $R_4$ each independently is a hydrogen atom, aliphatic group having 1 to 30 carbon atoms, aromatic group having from 6 to 30 carbon atoms, or heterocyclic group having from 2 to 30 carbon atoms; $R_5$ is an aliphatic group having from 1 to 30 carbon atoms, an aromatic group having from 6 to 30 carbon atoms, or a heterocyclic group; $R_3$ and $R_4$ may join each other to form a heterocyclic ring; p is an integer from 0 to 3; q and r are integers from 0 to 4; s is an integer from 0 to 2.

$X_1$ is an oxygen atom, sulfur atom, or $R_6N<$, where $R_6$ is a hydrogen atom or a monovalent group; wherein said monovalent group is an aliphatic group having from 1 to 30 carbon atoms, aromatic group having from 6 to 30 carbon atoms, heterocyclic group having from 2 to 30 carbon atoms, carbonamido group having from 1 to 30 carbon atoms, imido group having from 4 to 30 carbon atoms, $-OR_7$, $-SR_7$, $-COR_7$, $-CONR_7R_8$, $-COCOR_7$, $-COCOR_7R_8$, $-COOR_7$, $-COCOOR_9$, $-SO_2R_9$, $-SO_2OR_9$, $SO_2NR_7R_8$, or $-NR_7R_8$; wherein $R_7$ and $R_8$ each independently is a hydrogen atom, aliphatic group having from 1 to 30 carbon atoms, aromatic group having from 6 to 30 carbon atoms, or heterocyclic group having from 2 to 30 carbon atoms or $R_7$ and $R_8$may join each other to form a heterocyclic ring; $R_9$ is an aliphatic group having from 1 to 30 carbon atoms, aromatic group having from 6 to 30 carbon atoms, or a heterocyclic group having from 2 to 30 carbon atoms;

T is a group of atoms forming a 5-, 6-, or 7-membered ring by connecting with the carbon atoms wherein said group of atoms is $$-O-,\quad -\underset{R'}{\underset{|}{N}}-,\quad -\underset{O}{\underset{\|}{C}}-,\quad -S-,\quad -N=,$$

$$=N-,\quad -\underset{R'}{\underset{|}{C}}=,\quad =\underset{R'}{\underset{|}{C}}-,\quad \text{or}\quad -\overset{R'}{\underset{R''}{\overset{|}{\underset{|}{C}}}}-,$$

where R′ and R″ each independently is a hydrogen atom, alkyl group, aryl group, halogen atom, alkyloxy group, alkyloxycarbonyl group, arylcarbonyl group, alkylcarbamoyl group, arylcarbamoyl group, or cyano group.

19. An element as in claim 1, wherein said coupler moiety comprises at least one of M-I, M-II, M-III, M-IV M-V, M-VI, and M-VII:

M-I

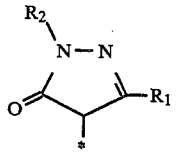

M-II

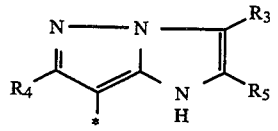

M-III

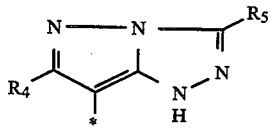

M-IV

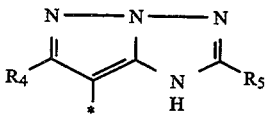

M-V

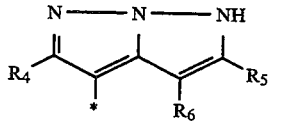

M-VI

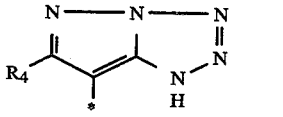

M-VII

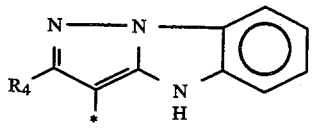

wherein:

$R_1$ and $R_2$ each independently is an alkyl group, a substituted alkyl group, an aryl group, a substituted aryl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsufonyl group, an alkylsulfonamido group, an arylsulfonamido group, a sulfamoyl group, an alkylsulfamoyl group, a dialkylsulfamoyl group, an arylsulfamoyl group, an alkylthio group, an arylthio group, cyano group, nitro group, or a halogen atom;

$R_3$, $R_4$, $R_5$, and $R_6$ are each independently a hydrogen atom, hydroxyl group, an unsubstituted or substituted alkyl group having from 1 to 20 carbon atoms, an aryl group having from 6 to 20 carbon atoms, a heterocyclic group, an alkylamino group having from 1 to 20 carbon atoms, an acylamino group having from 2 to 20 carbon atoms, an anilino group an alkoxycarbonyl group having from 2 to 20 carbon atoms, an alkylcarbonyl group having from 2 to 20 carbon atoms, an arylcarbonyl group having from 7 to 20 carbon atoms, an alkylthio group having from 1 to 20 carbon atoms, an arylthio group having from 6 to 20 carbon atoms, a carbamoyl group having from 1 to 20 carbon atoms, a sulfamoyl group having from 0 to 20 carbon atoms, or an alkyl sulfonamido group having from 6 to 20 carbon atoms.

20. An element as in claim 1, wherein said coupler moiety comprises at least one of Y-I, Y-II, and Y-III:

Y-I

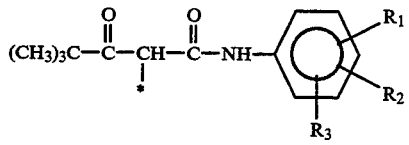

Y-II

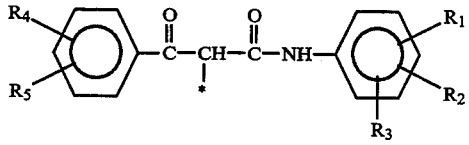

Y-III

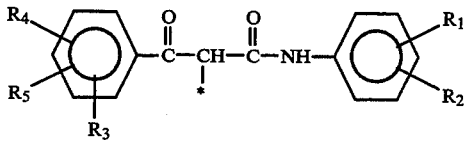

where:

$R_1$, $R_2$, $R_3$, $R_4$, and $R_5$ each independently is a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group, or thiocyano group.

21. An element as in claim 1, wherein said coupler moiety comprises at least one of W-I, W-II, W-III, and W-IV:

W-I

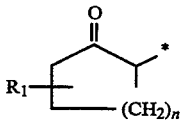

W-II

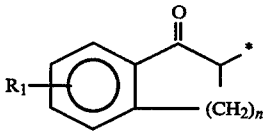

W-III

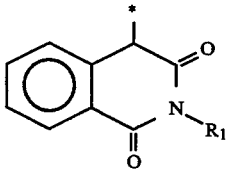

-continued

W-IV

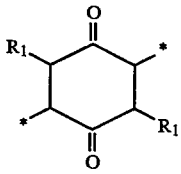

where $R_1$ is a ballast group and n is 1 or 2.

22. An element as in claim 1, wherein said coupler moiety comprises at least one of B-I, B-II, and B-III:

B-I

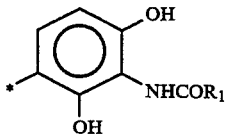

B-II

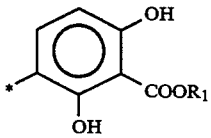

B-III

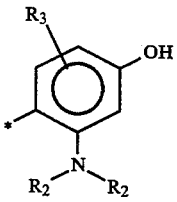

wherein $R_1$ is an alkyl group of 3 to 20 carbon atoms, a phenyl group, or a phenyl group substituted with the substituents hydroxy, halo, amino, alkyl group of 1 to 20 carbon atoms, or an alkoxy group of 1 to 20 carbon atoms;

each $R_2$ is independently a hydrogen atom, a halogen, an alkyl group of 1 to 20 carbon atoms, an alkenyl group of 1 to 20 carbon atoms, or an aryl group of 6 to 20 carbon atoms;

$R_3$ is one or more monovalent groups comprising a halogen, an alkyl group of 1 to 20 carbon atoms, and an alkoxy group of 1 to 20 carbon atoms.

23. An element as in claim 1, wherein said linking group comprises at least one of L-1, L-2, L-3, L-4, L-5, L-6, L-7, L-8, L-9, L-10, L-11, L-12, L-13 and L-14:

L-1

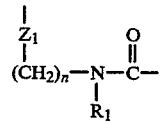

where n is 1, 2, 3, or 4;

L-2

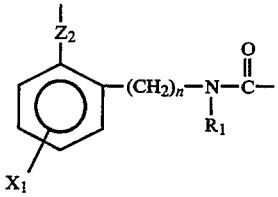

where n is 0 or 1;

-continued

L-3

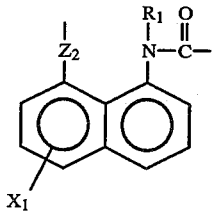

L-4

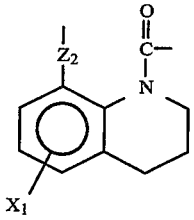

L-5

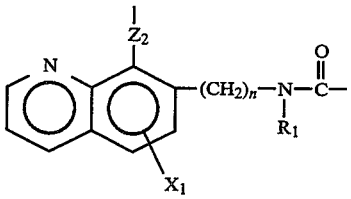

where n is 0 or 1;

L-6

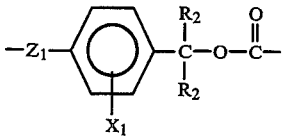

L-7

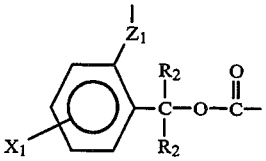

L-8

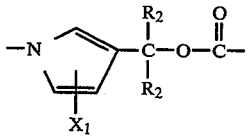

L-9

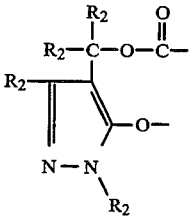

L-10

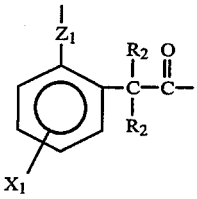

-continued

L-11

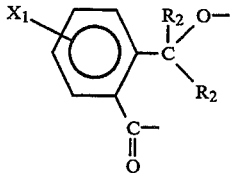

L-12

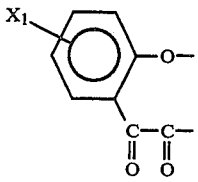

L-13

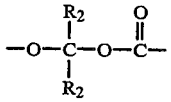

L-14

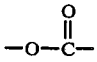

wherein
$Z_1$ is

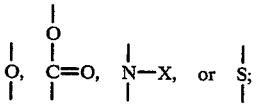

where X is a substituent;
$Z_2$ is

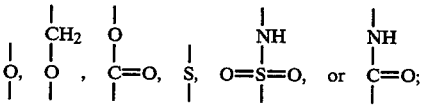

$R_1$ is a hydrogen atom, an alkyl group of 1 to 20 carbon atoms, or an aryl group of 6 to 30 carbon atoms;

each $R_2$ independently is a hydrogen atom, an alkyl group of 1 to 25 carbon atoms, a cycloalkyl group, a substituted cycloalkyl group, or an aryl group of 6 to 30 carbon atoms;

$X_1$ is a hydrogen atom, cyano, fluoro, chloro, bromo, iodo, nitro, an alkyl group of 1 to 20 carbon atoms, an aryloxy group, an alkoxycarbonyl group, a hydroxy group, a sulfonyl group, an acyl group, an alkoxy group, a sulfo group, $—OR_2$, $—COOR_2$, $—CONHR_2$, $—NHCOR_2$, $—NHSO_2R_2$, $—SO_2NHR_2$, or $—SO_2R_2$.

24. An element as in claim 1, wherein said Dye radical comprises azo, azamethine, or indoaniline dyes and dye precursors.

25. A diffusion transfer process for forming a color photographic image comprising the steps of:

providing an aqueous-developable photographic color diffusion transfer element comprising a single dimensionally stable support and one or more layers comprising radiation sensitive silver halide, a thermal solvent for facilitating the thermal diffusion of dyes through a hydrophilic binder, a dye-releasing coupler, and hydrophilic binder, wherein said dye is heat diffusible in said binder and thermal solvent, and wherein said dye-releasing coupler is of the structure Cp—L-Dye where Cp is a coupler radical selected from the group comprising cyan dye forming radicals, magenta dye forming radicals, yellow dye forming radicals, black dye forming radicals, and colorless product forming radicals, said Cp being substituted in the coupling position with a divalent linking group, L;

Dye is a dye radical exhibiting selective absorption in the visible spectrum; and where said —L-Dye group couples off upon reaction of said coupler radical with the oxidation product of a primary amine developing agent, and such that the Dye radical is subsequently released from the —L-Dye group;

and wherein said element is devoid of any developing agent or electron transfer agent;

exposing said element to actinic radiation;

processing said element by contacting said element to an external aqueous bath containing compounds selected from the group consisting of color developer compounds of the primary amine type;

washing said element;

drying said element to remove the imbibed water; and heating said element to effect dye diffusion transfer to an image receiving layer.

26. A process as in claim 25, wherein said support is an opaque reflection support.

27. A process as in claim 25, wherein said support is a transparent support.

28. A process as in claim 25, wherein said silver halide comprises greater than 95 mole percent silver chloride.

29. A process as in claim 25, wherein said dye-receiving layer comprises an ultraviolet filter dye.

30. A process as in claim 25, wherein said binder is selected from the group consisting of gelatin, polyvinylpyrrolidone, and polyvinylalcohol.

31. A process as in claim 25, wherein said Dye radical comprises azo, azamethine, or indoaniline dyes and dye precursors.

32. A process as in claim 25, wherein said process is devoid of bleaching, fixing, and bleaching/fixing steps.

33. An aqueous-developable photographic color diffusion transfer element comprising a single dimensionally stable support and one or more layers comprising radiation sensitive silver halide, thermal solvent for facilitating the thermal diffusion of dyes through a hydrophilic binder, a dye-releasing coupler, and hydrophilic binder, wherein said dye is heat diffusible in said binder and thermal solvent, and wherein said dye-releasing coupler is of the structure Cp—L-Dye where Cp is a cyan dye forming radical, magenta dye forming radical, yellow dye forming radical, black dye forming radical, or colorless product forming radical, said Cp being substituted in the coupling position with a divalent linking group, L;

Dye is a dye radical exhibiting selective absorption in the visible spectrum; and where said —L-Dye group couples off upon reaction of said coupler radical with the oxidation product of a primary amine developing agent, and such that the Dye radical is subsequently released from the L-Dye group;

and wherein said element is devoid of any developing agent or electron transfer agent.

34. An element as in claim 33, which in addition contains a dye-receiving layer intermediate said support and said silver halide containing and said dye-releasing coupler containing layers.

35. An element as in claim 33, where said dye-receiving layer comprises polymer selected from the group consisting of poly-carbonates, polyurethanes, polyesters, polyvinyl chlorides, poly(styrene-co-acrylonitrile)s, poly(caprolactone)s and mixtures thereof.

36. An element as in claim 33, where said support is an opaque reflection support.

37. An element as in claim 33, where said support is a transparent support.

38. An element as in claim 34, further comprising a stripping layer intermediate said dye-receiving layer and any layers containing silver halide or dye-releasing coupler.

39. An element as in claim 38, wherein said stripping layer contains a stripping agent coated at levels of 3–500 $mg/m^2$.

40. An element as in claim 39, wherein said stripping agent has the following formula:

$$CF_3(CF_2)_n—SO_2—\overset{\overset{R_1}{|}}{N}—CH_2R_2$$

wherein $R_1$ is an alkyl group having from 1 to 6 carbon atoms, a substituted alkyl group having from 1 to 6 carbon atoms, an aryl group having from 6 to 10 carbon atoms, or substituted aryl group having from 6 to 10 carbon atoms; $R_2$ is $$—\overset{\overset{O}{\|}}{C}—O—(CH_2CH_2O)_x—R_3,$$

$$—\overset{\overset{O}{\|}}{C}—O—(CH_2)_y—R_3, \quad \text{or}$$

$$—CH_2—O—(CH_2CH_2O)_z—R_3;$$

$R_3$ is H or $R_1$; n is an integer from 4 to 19; x and y each independently represents an integer of from 2 to 50; and z represents an integer of from 1 to 50.

41. An element as in claim 40, wherein $R_1$ is ethyl, $R_2$ is $$—\overset{\overset{O}{\|}}{C}—O—(CH_2CH_2O)_x—H,$$

n is 6 to 8, and x is 25 to 50.

42. An element as in claim 40, wherein $R_1$ is ethyl, $R_2$ is $$—\overset{\overset{O}{\|}}{C}—O(CH_2)_y—H,$$

n is 6 to 8, and y is 25 to 50.

43. An element as in claim 34, wherein said dye-receiving layer comprises an ultraviolet filter dye.

44. An element as in claim 33, wherein said binder is gelatin.

45. An element as in claim 33, wherein said thermal solvent is selected from the group consisting of phenols, benzamides, hydroxybenzoates, and hydroxybenzamides.

46. An element as in claim 33, wherein said Dye radical comprises azo, azamethine, or indoaniline dyes and dye precursors.

47. A diffusion transfer process for forming a color photographic image comprising the steps of:

providing an aqueous-developable photographic color diffusion transfer element comprising a single dimensionally stable support and one or more layers comprising radiation sensitive silver halide, a thermal solvent for facilitating the thermal diffusion of dyes through a hydrophilic binder, a dye-releasing coupler, and hydrophilic binder, wherein said dye is heat diffusible in said binder and thermal solvent, and wherein said dye-releasing coupler is of the structure Cp—L-Dye where Cp is a coupler radical selected from the group comprising cyan dye forming radicals, magenta dye forming radicals, yellow dye forming radicals, black dye forming radicals, and colorless product forming radicals, said Cp being substituted in the coupling position with a divalent linking group, L;

Dye is a dye radical exhibiting selective absorption in the visible spectrum; and where said —L-Dye group couples off upon reaction of said coupler radical with the oxidation product of a primary amine developing agent, and such that the Dye radical is subsequently released from the —L-Dye group;

and wherein said element is devoid of any developing agent or electron transfer agent, and wherein said element in addition contains a dye-receiving layer intermediate said support and any layer containing silver halide or dye-releasing coupler;

exposing said element to actinic radiation;

processing said element by contacting said element to an external aqueous bath containing compounds selected from the group consisting of color developer compounds of the primary amine type;

washing said element;

drying said element to remove the imbibed water; and heating said element to effect dye diffusion transfer to an image receiving layer.

48. A process as in claim 47, wherein said dye-receiving layer comprises polymer selected from the group consisting of poly-carbonates, polyurethanes, polyesters, polyvinyl chlorides, poly(styrene-co-acrylonitrile)s, poly(caprolactone)s and mixtures thereof.

49. A process as in claim 47, wherein said support is an opaque reflection support.

50. A process as in claim 47, wherein said support is a transparent support.

51. A process as in claim 47, wherein said diffusion transfer element comprises a stripping layer intermediate said dye-receiving layer and said silver halide containing and said dye-releasing coupler containing layers.

52. A process as in claim 47, wherein said silver halide comprises greater than 95 mole percent silver chloride.

53. A process as in claim 47, wherein said dye-receiving layer comprises an ultraviolet filter dye.

54. A process as in claim 47, wherein said binder is selected from the group consisting of gelatin, polyvinylpyrrolidone, and polyvinylalcohol.

55. A process as in claim 47, wherein said Dye radical comprises azo, azamethine, or indoaniline dyes and dye precursors.

56. A process as in claim 47, wherein said process is devoid of bleaching, fixing, and bleaching/fixing steps.

* * * * *

IN THE UNITED STATES PATENT AND TRADEMARK OFFICE

CERTIFICATE OF CORRECTION

Patent No.: 5,356,750

Dated: October 18, 1994

Inventor(s): John Texter et al.

It is certified that errors appear in the above-identified patent and that said Letters Patent is hereby corrected as shown below:

Column 51, line 48, "$R_8$may" should read --$R_8$ may--.

Column 58, line 63,

" $-\overset{O}{\overset{\|}{C}}-O(CH_2)_y-H$. " should read --$-\overset{O}{\overset{\|}{C}}-O-(CH_2)_y-H$--.

Signed and Sealed this

Twenty-fifth Day of July, 1995

Bruce Lehman

BRUCE LEHMAN

*Commissioner of Patents and Trademarks*

*Attest:*

*Attesting Officer*